US011644788B2

(12) United States Patent
Kamimori

(10) Patent No.: US 11,644,788 B2
(45) Date of Patent: May 9, 2023

(54) IMAGE FORMING APPARATUS CAPABLE OF SUPPRESSING TONER FUSION ON A PHOTOSENSITIVE MEMBER

(71) Applicant: CANON KABUSHIKI KAISHA, Tokyo (JP)

(72) Inventor: Yasuki Kamimori, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/864,573

(22) Filed: Jul. 14, 2022

(65) Prior Publication Data

US 2023/0048499 A1 Feb. 16, 2023

(30) Foreign Application Priority Data

Aug. 16, 2021 (JP) ..... JP2021-132485

(51) Int. Cl.
*G03G 21/00* (2006.01)

(52) U.S. Cl.
CPC ..... *G03G 21/0035* (2013.01)

(58) Field of Classification Search
CPC ..... G03G 21/0005; G03G 21/0011; G03G 21/0035
USPC ..... 399/349, 350, 353, 354
See application file for complete search history.

(56) References Cited

U.S. PATENT DOCUMENTS

| | | | | |
|---|---|---|---|---|
| 7,711,307 | B2 * | 5/2010 | Kageyama | G03G 21/0017 399/349 |
| 8,190,077 | B2 | 5/2012 | Naruse et al. | |
| 9,098,049 | B2 * | 8/2015 | Asaoka et al. | G03G 21/0035 |
| 9,760,041 | B2 | 9/2017 | Omata et al. | |
| 9,910,397 | B2 | 3/2018 | Kamimori | |
| 9,927,741 | B2 | 3/2018 | Noguchi et al. | |
| 9,933,746 | B2 | 4/2018 | Fukuda et al. | |

FOREIGN PATENT DOCUMENTS

| | | | |
|---|---|---|---|
| JP | 2009-300860 | A | 12/2009 |
| JP | 5218142 | B2 | 6/2013 |
| JP | 2014-228849 | A | 12/2014 |
| JP | 6572060 | B2 | 9/2019 |

* cited by examiner

*Primary Examiner* — William J Royer
(74) *Attorney, Agent, or Firm* — Venable LLP

(57) ABSTRACT

An image forming apparatus includes a rotatable photosensitive member, an image forming portion, a cleaning device, and a controller. The cleaning device includes a blade, a rotatable brush, and an applying portion. The controller controls the applying portion so as to apply a bias to the brush so that a potential of the brush has a polarity opposite to a normal charge polarity of toner. When a tensile strength of the brush is A (cn/dtex), a thickness of the brush is B (denier), a bristle density of the brush is C (kF/inch$^2$), a length of the brush is D (mm), and an elastic deformation rate of the surface of the photosensitive member is E (%), the following relationships are satisfied: $48(\%) \leq E \leq 60(\%)$, and $400 \leq \{A \times B^2 \times C/D^2\} \leq 20408$.

15 Claims, 11 Drawing Sheets

| | E | A | B | C | D | BRI*6 | | VR*8 | |
|---|---|---|---|---|---|---|---|---|---|
| EXP. No. | EDR*1 [%] | BTS*2 [cn/dtex] | BFT*3 [denier] | BBD*4 [kF/inch$^2$] | BFL*5 [mm] | $A \times B^2 \times C/D^2$ | VATB*7 [V] | F*9 | DL*10 |
| 1 | 45 | 80 | 6 | 75 | 4.5 | 10667 | 0 | ○ | × |
| 2 | 48 | 80 | 6 | 75 | 4.5 | 10667 | 0 | × | ○ |
| 3 | 55 | 80 | 6 | 75 | 4.5 | 10667 | 0 | × | ○ |
| 4 | 60 | 80 | 6 | 75 | 4.5 | 10667 | 0 | × | ○ |
| 5 | 62 | 80 | 6 | 75 | 4.5 | 10667 | 0 | × | ○ |
| 6 | 45 | 80 | 10 | 45 | 4.5 | 17778 | 0 | ○ | × |
| 7 | 48 | 80 | 10 | 45 | 4.5 | 17778 | 0 | × | ○ |
| 8 | 55 | 80 | 10 | 45 | 4.5 | 17778 | 0 | × | ○ |
| 9 | 60 | 80 | 10 | 45 | 4.5 | 17778 | 0 | × | ○ |
| 10 | 62 | 80 | 10 | 45 | 4.5 | 17778 | 0 | × | ○ |
| 11 | 45 | 80 | 15 | 30 | 4.5 | 26667 | 0 | ○ | × |
| 12 | 48 | 80 | 15 | 30 | 4.5 | 26667 | 0 | ○ | × |
| 13 | 55 | 80 | 15 | 30 | 4.5 | 26667 | 0 | × | ○ |
| 14 | 60 | 80 | 15 | 30 | 4.5 | 26667 | 0 | × | ○ |
| 15 | 62 | 80 | 15 | 30 | 4.5 | 26667 | 0 | × | ○ |
| 16 | 45 | 80 | 15 | 30 | 4.2 | 30612 | 0 | ○ | × |
| 17 | 48 | 80 | 15 | 30 | 4.2 | 30612 | 0 | ○ | × |
| 18 | 55 | 80 | 15 | 30 | 4.2 | 30612 | 0 | ○ | × |
| 19 | 60 | 80 | 15 | 30 | 4.2 | 30612 | 0 | × | ○ |
| 20 | 62 | 80 | 15 | 30 | 4.2 | 30612 | 0 | × | ○ |
| 21 | 45 | 80 | 15 | 30 | 4 | 33750 | 0 | ○ | × |
| 22 | 48 | 80 | 15 | 30 | 4 | 33750 | 0 | ○ | × |
| 23 | 55 | 80 | 15 | 30 | 4 | 33750 | 0 | ○ | × |
| 24 | 60 | 80 | 15 | 30 | 4 | 33750 | 0 | ○ | × |
| 25 | 62 | 80 | 15 | 30 | 4 | 33750 | 0 | × | ○ |
| 26 | 45 | 80 | 10 | 45 | 4.5 | 17778 | 300 | ○ | × |
| 27 | 48 | 80 | 10 | 45 | 4.5 | 17778 | 300 | ○ | ○ |
| 28 | 55 | 80 | 10 | 45 | 4.5 | 17778 | 300 | ○ | ○ |
| 29 | 60 | 80 | 10 | 45 | 4.5 | 17778 | 300 | ○ | ○ |
| 30 | 62 | 80 | 10 | 45 | 4.5 | 17778 | 300 | × | ○ |
| 31 | 48 | 80 | 10 | 45 | 4.5 | 17778 | 300 | ○ | ○ |
| 32 | 48 | 80 | 10 | 45 | 4.2 | 20408 | 300 | ○ | ○ |
| 33 | 48 | 80 | 10 | 45 | 4 | 22500 | 300 | ○ | × |
| 34 | 48 | 80 | 10 | 45 | 3.6 | 27778 | 300 | ○ | × |
| 35 | 48 | 40 | 6 | 45 | 4.5 | 3200 | 300 | ○ | ○ |
| 36 | 48 | 40 | 10 | 45 | 4.5 | 8889 | 300 | ○ | ○ |
| 37 | 48 | 40 | 15 | 45 | 4.5 | 20000 | 300 | ○ | ○ |
| 38 | 48 | 40 | 18 | 45 | 4.5 | 28800 | 300 | ○ | × |
| 39 | 48 | 40 | 15 | 30 | 4.5 | 13333 | 300 | ○ | ○ |
| 40 | 48 | 40 | 15 | 45 | 4.5 | 20000 | 300 | ○ | ○ |
| 41 | 48 | 40 | 15 | 75 | 4.5 | 33333 | 300 | ○ | × |

Fig. 8A

| |
|---|
| Fig. 8A |
| Fig. 8B |

*1: "EDR" is elastic deformation rate.

*2: "BTS" is brush tensile strength.

*3: "BFT" is brush fiber thickness.

*4: "BBD" is brush bristle density.

*5: "BFL" is brush fiber length.

*6: "BRI" is brush rigidity index.

*7: "VATB" is voltage applied to brush.

*8: "VR" is verification result.

*9: "F" is fusion.

*10: "DL" is drum lifetime.

Fig. 8B

| | E | A | B | C | D | BRI*6 | | | VR*9 | |
|---|---|---|---|---|---|---|---|---|---|---|
| EXP. No. | EDR*1 [%] | BTS*2 [cn/dtex] | BFT*3 [denier] | BBD*4 [kF/inch$^2$] | BFL*5 [mm] | $A \times B^2 \times C/D^2$ | VATB*7 [V] | CPE*8 | F*10 | *11 DL |
| 42 | 55 | 80 | 10 | 45 | 4.5 | 17778 | 0 | NO | × | ○ |
| 43 | 55 | 80 | 10 | 45 | 4.5 | 17778 | 150 | NO | × | ○ |
| 44 | 55 | 80 | 10 | 45 | 4.5 | 17778 | 300 | NO | ○ | ○ |
| 45 | 55 | 80 | 10 | 45 | 4.5 | 17778 | 450 | NO | × | ○ |
| 46 | 55 | 80 | 10 | 45 | 4.5 | 17778 | 600 | NO | × | ○ |
| 47 | 55 | 80 | 10 | 45 | 4.5 | 17778 | 750 | NO | × | ○ |
| 48 | 55 | 80 | 10 | 45 | 4.5 | 17778 | 900 | NO | × | ○ |
| 49 | 55 | 80 | 10 | 45 | 4.5 | 17778 | 0 | YES | × | ○ |
| 50 | 55 | 80 | 10 | 45 | 4.5 | 17778 | 150 | YES | × | ○ |
| 51 | 55 | 80 | 10 | 45 | 4.5 | 17778 | 300 | YES | ○ | ○ |
| 52 | 55 | 80 | 10 | 45 | 4.5 | 17778 | 450 | YES | ○ | ○ |
| 53 | 55 | 80 | 10 | 45 | 4.5 | 17778 | 600 | YES | ○ | ○ |
| 54 | 55 | 80 | 10 | 45 | 4.5 | 17778 | 750 | YES | × | ○ |
| 55 | 55 | 80 | 10 | 45 | 4.5 | 17778 | 900 | YES | × | ○ |

*1: "EDR" is elastic deformation rate.

*2: "BTS" is brush tensile strength.

*3: "BFT" is brush fiber thickness.

*4: "BBD" is brush bristle density.

*5: "BFL" is brush fiber length.

*6: "BRI" is brush rigidity index.

*7: "VATB" is voltage applied to brush.

*8: "CPE" is cleaning pre-exposure.

*9: "VR" is verification result.

*10: "F" is fusion.

*11: "DL" is drum lifetime.

Fig. 10

IMAGE FORMING APPARATUS CAPABLE OF SUPPRESSING TONER FUSION ON A PHOTOSENSITIVE MEMBER

FIELD OF THE INVENTION AND RELATED ART

The present invention relates to an image forming apparatus, such as a copying machine, a printer, or a facsimile machine, using an electrophotographic type.

Conventionally, in the image forming apparatus of the electrophotographic type, a toner image formed on a surface of a photosensitive member through steps of charging, exposure, and development is directly transferred onto a recording material or is transferred onto the recording material through an intermediary transfer member. On a surface of the photosensitive member on which a transfer step of the toner image from the photosensitive member onto the recording material or the intermediary transfer member which are transfer-receiving members is ended, untransferred toner (transfer residual toner), an external additive of the toner, an electric discharge product, and the like remain. For that reason, there is a need to remove these from the surface of the photosensitive member in advance of a subsequent image forming process. As a method for removing the transfer residual toner and the like from the surface of the photosensitive member, various methods such as a method using a fur brush, a magnetic brush, or the like, and a method using a cleaning blade are used. Of these methods, the method in which the transfer residual toner is scraped off from the surface of the photosensitive member by rubbing the surface of the photosensitive member with the cleaning blade has been more widely used since a constitution thereof is relatively simple and inexpensive.

With speed-up and image quality improvement of the image forming apparatus in recent years, the toner used lowers in melting point and is closer in shape to a sphere, so that it has become difficult to ensure a cleaning property only by the cleaning blade. Therefore, there is a method in which an auxiliary cleaning means for assisting removal of the transfer residual toner by the cleaning blade is used. For example, a method in which a fur brush (brush roller) which contacts the surface of the photosensitive member and which is capable of applying a bias is provided upstream of the cleaning blade with respect to a movement direction of the surface of the photosensitive member has been proposed (Japanese Laid-Open Patent Application (JP-A) 2009-300860). According to this method, at least a part of the transfer residual toner before reaches the cleaning blade can be removed by the fur brush, so that a load on the cleaning blade can be reduced and thus a cleaning property can be improved.

Further, in recent years, in order to prolong a lifetime of the photosensitive member, there is a photosensitive member of a thermosetting type in which a surface of the photosensitive member is made hard to be abraded. Further, there is a tendency that an exchange interval of the cleaning blade is extended in conformity with the photosensitive member. When the surface of the photosensitive member is not readily abraded, damage such as shuddering or reverse (turning-up) of the cleaning blade, or chipping or abrasion of an edge of the cleaning blade, or the like is liable to occur.

Further, when the surface of the photosensitive member is not readily abraded, a phenomenon which is called "fusion" or "filming" such that a component of the toner or an external additive of the toner is deposited and accumulated (grown) (hereinafter, this phenomenon is simply referred to as "toner fusion") is liable to occur. Therefore, a method in which the fur brush is contacted to the photosensitive member on a side upstream of the cleaning blade with respect to the movement direction of the surface of the photosensitive member and the photosensitive member surface is mechanically abraded, and thus a surface layer of the photosensitive member is refreshed has been proposed (JP-A 2014-228849).

Thus, in order to meet the speed-up and the lifetime extension in recent years, a role of the fur brush as the auxiliary cleaning means for improving the cleaning property has become important.

In JP-A 2009-300860, there is a description as to a cleaning property such that in order to enhance contact probability between the fur brush and the toner, the cleaning property is improved by defining a bristle (brush) density of the fur brush or by defining a resistance value of the fur brush. Here, the fur brush plays a role of wearing the surface layer of the photosensitive member in addition to the role of the cleaning. However, in JP-A 2009-300860, there is no description as to the wearing or the abrasion of the surface layer of the photosensitive member. Further, also in JP-A 2014-228849, there is no description as to a surface layer characteristic of the photosensitive member and a rigidity characteristic of the fur brush. A degree of the abrasion of the surface layer of the photosensitive member is different depending on hardness of the surface layer of the photosensitive member, and bristles and a contact condition of the fur brush.

As described above, in recent years, there is a tendency that hardness of the surface layer of the photosensitive member is increased. Even in the case where the surface layer of the photosensitive member is hard, when a measuring amount (abrasion amount) of the surface layer of the photosensitive member is small, the toner fusion of the surface of the photosensitive member occurs. On the other hand, when the wearing amount (abrasion amount) is large, a lifetime of the photosensitive member becomes short. This is because scars on the surface layer of the photosensitive member with respect to a circumferential direction increase and a state in which surface roughness is large is formed, and thus inconveniences such as improper cleaning occurs, or the like.

SUMMARY OF THE INVENTION

A principal object of the present invention is to suppress an occurrence of toner fusion of a surface of a photosensitive member while achieving lifetime extension of the photosensitive member.

This object can be accomplished by an image forming apparatus according to the present invention. According to an aspect of the present invention, there is provided an image forming apparatus comprising: a rotatable photosensitive member; an image forming portion configured to form a toner image on the photosensitive member; a cleaning device configured to clean the photosensitive member, wherein the cleaning device comprises: a blade contacting the photosensitive member at a first contact portion and configured to clean the photosensitive member; a rotatable brush contacting the photosensitive member at a second contact portion upstream of the first contact portion with respect to a rotational direction of the photosensitive member and configured to collect toner remaining on the photosensitive member; and an applying portion configured to apply a bias to the brush; and a controller configured to control the applying portion, wherein the controller controls the applying portion so as to apply the bias to the brush so that a potential of the brush has a polarity opposite to a normal charge polarity of the toner when an image forming region of a surface of the photosensitive member passes through the second contact portion, and when a tensile strength of the brush is A (cn/dtex), a thickness of the brush is B (denier), a bristle density of the brush is C (kF/inch$^2$), a length of the brush is D (mm), and an elastic deformation rate of the surface of the photosensitive member is E (%), the following relationships are satisfied: $48(\%) \leq E \leq 60(\%)$, and $400 \leq \{A \times B^2 \times C/D^2\} \leq 20408$.

Further features of the present invention will become apparent from the following description of exemplary embodiments with reference to the attached drawings.

BRIEF DESCRIPTION OF THE DRAWINGS

FIGS. 8A and 8B include a table showing an evaluation result as to the embodiment 1.

FIG. 10 is a graph showing an evaluation result as to the embodiment 2.

DESCRIPTION OF THE EMBODIMENTS

In the following, an image forming apparatus according to the present invention will be described specifically with reference to the drawings.

Embodiment 1

1. General Structure and Operation of Image Forming Apparatus

Figure 1:
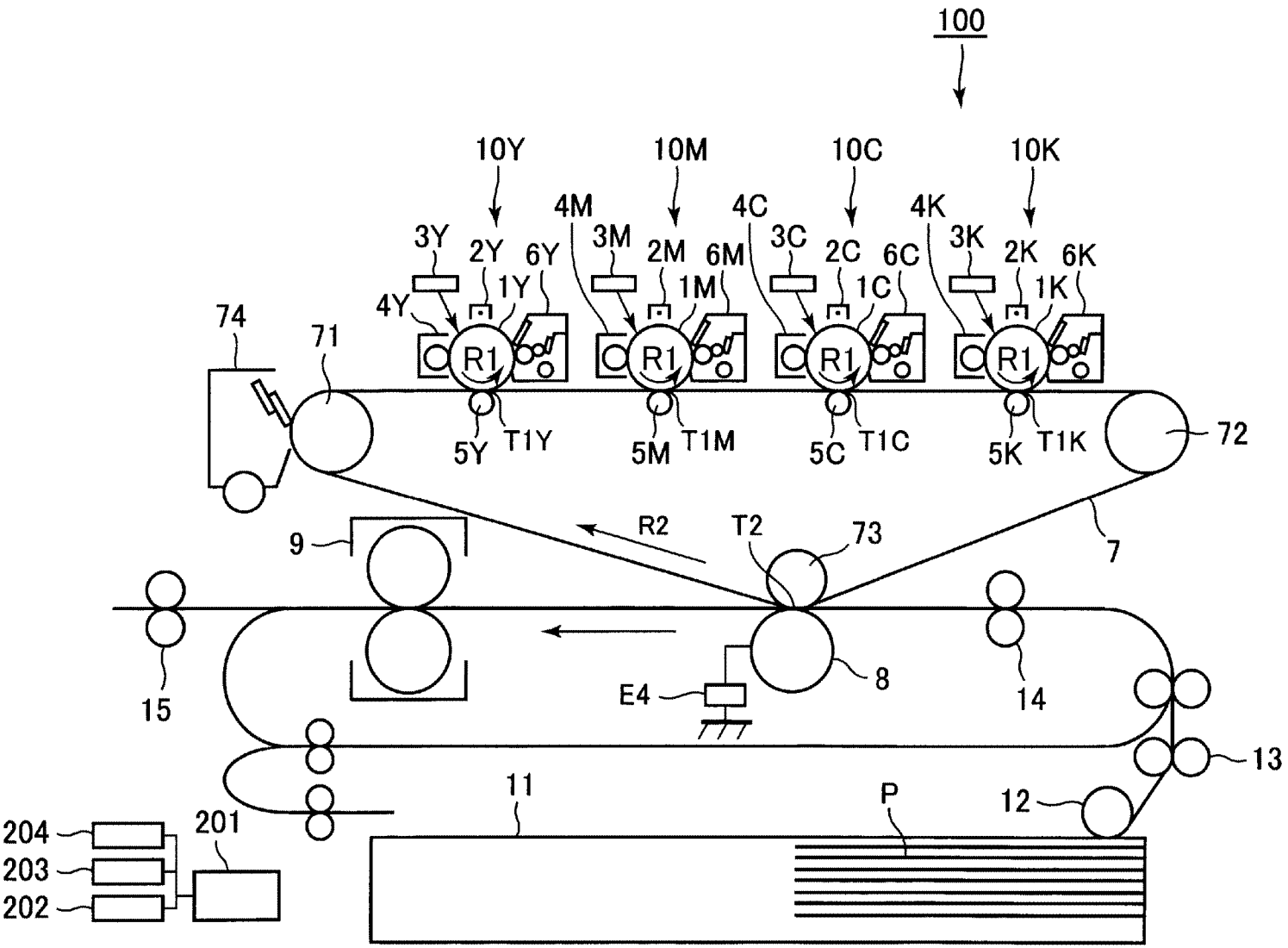
FIG. 1 is a schematic sectional view of an image forming apparatus.

FIG. 1 is a schematic sectional view of an image forming apparatus 100 of an embodiment 1. The image forming apparatus 100 of this embodiment is a four-color based full-color printer of a tandem type in which a full-color image is capable of being formed by using an electrophotographic process and in which an intermediary transfer type is employed.

Figure 2:
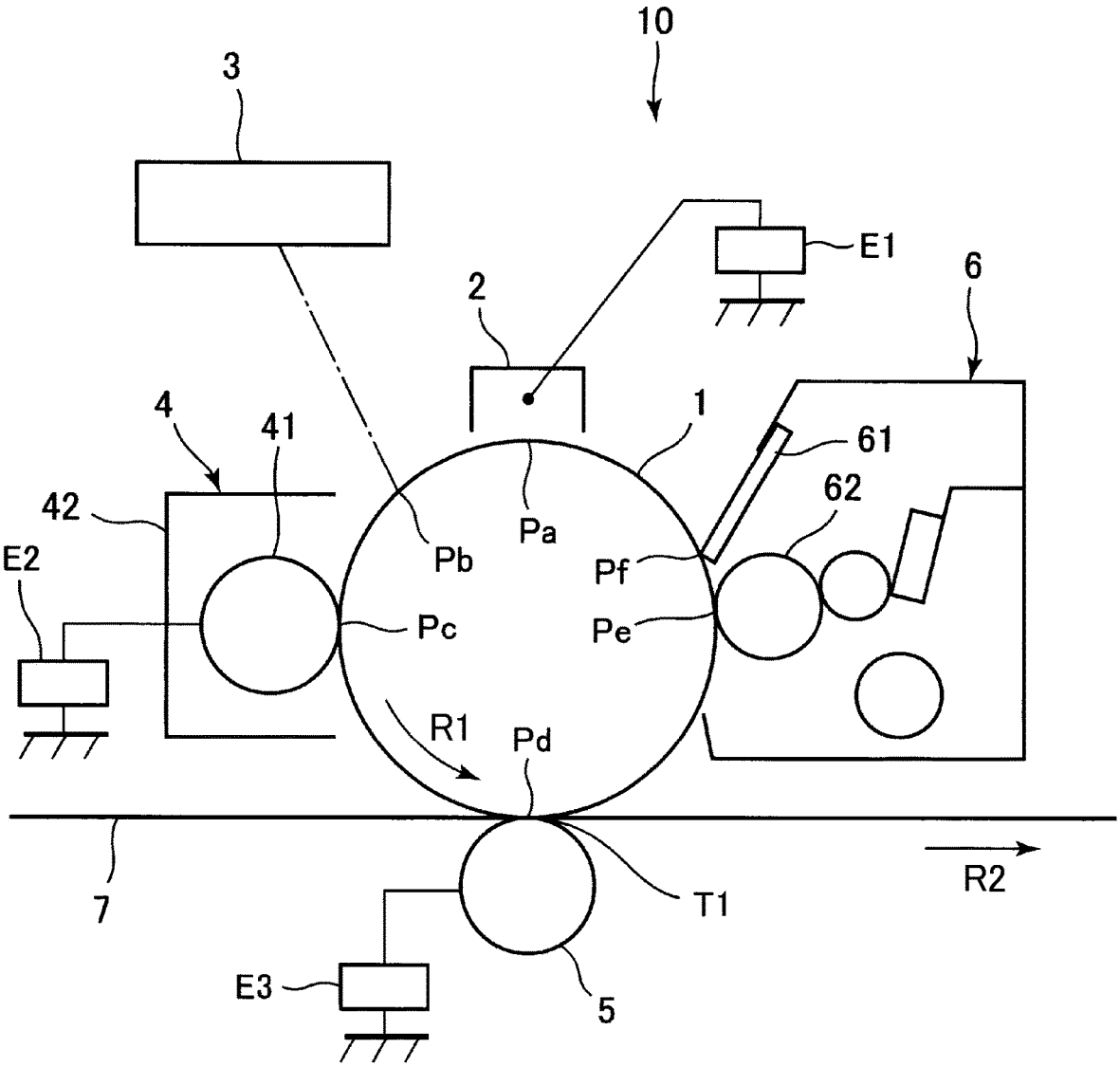
FIG. 2 is a schematic sectional view of an image forming portion.

The image forming apparatus 100 includes, as a plurality of image forming portions (stations), four image forming portions 10Y, 10M, 10C, 10K for forming colors of yellow (Y), magenta (M), cyan (C) and black (K), respectively. These image forming portions 10Y, 10M, 10C and 10K are disposed in line along a movement direction of an image transfer surface, formed substantially horizontally, of an intermediary transfer belt 7 described later. As regards elements having the same or corresponding functions or constitutes in the respective image forming portions 10Y, 10M, 10C and 10K, these elements are collectively described in some instances by omitting suffixes, Y, M, C and K of reference numerals or symbols representing the elements for associated colors. FIG. 2 is a schematic sectional view showing a single image forming portion 10 as a representative. In this embodiment, the image forming portions 10 are constituted by including photosensitive drums 1 (1Y, 1M, 1C, 1K), charging rollers 4 (4Y, 4M, 4C, 4K), exposure devices 3 (3Y, 3M, 3C, 3K), developing devices 8 (8Y, 8M, 8C, 8K), primary transfer rollers 5 (5Y, 5M, 5C, 5K), cleaning devices 6 (6Y, 6M, 6C, 6K), and the like which are described later.

The image forming apparatus includes, as a first image bearing member for bearing a toner image, the photosensitive drum 1 which is a rotatable drum type (cylindrical) photosensitive member (electrophotographic photosensitive member). The photosensitive drum 1 is rotated (rotationally driven) at a predetermined peripheral speed (process speed) in an arrow R1 direction (counterclockwise direction) in FIG. 1 by transmission thereto a driving force from a drum driving motor (not shown) as a driving source. A surface of the rotating photosensitive drum 1 is electrically charged uniformly to a predetermined polarity (negative in this embodiment) and a predetermined potential by the charging device 2 as a charging means. During the charging process, to the charging device 2, a charging bias (charging voltage) is applied by a charging power source (high-voltage power source) E1.

The charged surface of the photosensitive drum 1 is subjected to scanning exposure to light depending on an image signal by the exposure device 3 as an exposure means, so that an electrostatic latent image (electrostatic image) is formed on the photosensitive drum 1. The electrostatic latent image formed on the photosensitive drum 1 is developed (visualized) by being supplied with toner as a developer by the developing device 4 as a developing means, so that a toner image (developer image) is formed on the photosensitive drum 1. In this embodiment, on an exposure portion (image portion) of the photosensitive drum 1 where an absolute value of a potential is lowered through exposure to light after the uniform charging process, the toner charged to the same polarity (negative in this embodiment) as a charge polarity of the photosensitive drum 1 is deposited (reverse development type). During development, to a developing sleeve 41 of the developing device 4, a predetermined developing bias (developing voltage) is applied by a developing power source (high-voltage power source) E2. In this embodiment, a normal charge polarity of the toner which is the charge polarity of the toner during the development is the negative (−) polarity.

An intermediary transfer belt 7, which is a rotatable intermediary transfer member, constituted by an endless belt as a second image bearing member for bearing the toner image is provided so as to oppose the four photosensitive drums 1Y, 1M, 1C and 1K. The intermediary transfer belt 7 is extended around, as a plurality of stretching rollers, a driving roller 71, a tension roller 72, and a secondary transfer opposite roller 73 and is stretched with predetermined tension. A driving force is transmitted from a belt driving motor (not shown) as a driving source to the intermediary transfer belt 7, and the driving roller 71 is rotationally driven and thus the intermediary transfer belt 7 is rotated (circulated and moved) at a predetermined peripheral speed (process speed) corresponding to the peripheral speed of the photosensitive drums 1 in an arrow R2 direction (clockwise direction). On an inner peripheral surface side of the intermediary transfer belt 7, the primary transfer rollers 5Y, 5M, 5C and 5K which are roller-shaped primary transfer members (transfer devices) as primary transfer means are provided correspondingly to the photosensitive drums 1Y, 1M, 1C and 1K, respectively. The primary transfer roller 5 is pressed toward the photosensitive drum 1 and is contacted to the photosensitive drum 1 via the intermediary transfer belt 7, and forms a primary transfer portion (primary transfer nip) T1 which is a contact portion between the photosensitive drum 1 and the intermediary transfer belt 7. The stretching rollers, of the plurality of stretching rollers, other than the driving roller 71, and the respective primary transfer rollers 5 are rotated with the rotation of the intermediary transfer belt 7. The toner image formed on the photosensitive drum 1 is transferred (primary-transferred) onto the rotating intermediary transfer belt 7 by the action of the primary transfer roller 5 in the primary transfer nip T1. During the primary transfer, to the primary transfer roller 5, a predetermined primary transfer bias (primary transfer voltage) which is a DC voltage of a polarity (positive in this embodiment) opposite to the normal charge polarity of the toner is applied by a primary transfer power source (high-voltage power source) E3. For example, during full-color image formation, toner images of yellow, magenta, cyan and black formed on the photosensitive drums 1 are successively primary-transferred superposedly onto the intermediary transfer belt 7 in the same image position (image forming region).

On an outer peripheral surface side, in a position opposing a secondary transfer opposite roller 73, a secondary transfer roller 8 which is a roller-shaped secondary transfer member as a secondary transfer means is provided. The secondary transfer roller 8 is pressed toward the secondary transfer opposite roller 73 and is contacted to the secondary transfer opposite roller 73 via the intermediary transfer belt 7, and forms a secondary transfer portion (secondary transfer nip) T2 which is a contact portion between the intermediary transfer belt 7 and the secondary transfer roller 8. The toner image formed on the intermediary transfer belt 7 is transferred (secondary-transferred) onto a recording material P nipped and fed by the intermediary transfer belt 7 and the secondary transfer roller 8 by the action of the secondary transfer roller 8 in the secondary transfer portion T2. During the secondary transfer, to the secondary transfer roller 8, a predetermined secondary transfer bias (secondary transfer voltage) which is a DC voltage of the polarity (positive in this embodiment) opposite to the normal charge polarity of the toner is applied by a secondary transfer power source 26. The secondary transfer opposite roller 73 is electrically grounded (connected to the ground). Incidentally, a roller corresponding to the secondary transfer opposite roller 73 in this embodiment may be used as a secondary transfer member, and to this roller, a secondary transfer voltage of the same polarity as the normal charge polarity of the toner may be applied. In this case, a roller corresponding to the secondary transfer roller 8 may only be required to be used as an opposite electrode and to be electrically grounded. The recording material (transfer material, recording medium, sheet) P such as paper or a plastic sheet is accommodated in a recording material cassette 11 as a recording material accommodated portion. The recording material P accommodated in the recording material cassette 11 is separated and fed one by one from the cassette 11 by a feeding roller 12 or the like as a feeding means. This recording material P is conveyed toward a registration roller pair 14 as a conveying means by a conveying roller pair 13 as a conveying means. Then the recording material P is timed to the toner image on the intermediary transfer belt 7 and is conveyed toward the secondary transfer portion T2 by the registration roller pair 14.

The recording material P on which the toner image is transferred is conveyed to a fixing device 9 as a fixing means. The fixing device 50 fixes (melts, sticks) the toner image on the surface of the recording material P by heating and pressing the recording material P, on which the unfixed toner image is carried, through nipping and conveyance of the recording material P by a rotatable fixing member pair. The recording material P on which the toner image is fixed is discharged (outputted) onto a discharge tray (not shown) or the like provided on an outside of an apparatus main assembly of the image forming apparatus 100 by a discharging roller pair 15 as a discharging means.

On the other hand, a deposited matter such as toner (primary-transfer residual toner) remaining on the photosensitive drum 1 after the primary transfer is removed and collected from the surface of the photosensitive drum 1 by the cleaning device 6 as a cleaning means. A deposited matter such as the toner (secondary-transfer residual toner) remaining on the intermediary transfer belt 7 after the secondary transfer is removed and collected from the surface of the intermediary transfer belt 7 by a belt cleaning device 74 as an intermediary transfer member cleaning means.

With respect to a rotational direction of the photosensitive drum 1, a position on the photosensitive drum 1 where the charging process is performed by the charging device 2 is a charging position Pa. Further, with respect to the rotational direction of the photosensitive drum 1, a position on the photosensitive drum where the photosensitive drum surface is irradiated with light emitted by the exposure device 3 is an exposure position Pb. Further, with respect to the rotational direction of the photosensitive drum 1, a position (opposing portion to the developing sleeve 41) on the photosensitive drum 1 to which the toner is supplied by the developing device 4 is a developing position Pc. Further, with respect to the rotational direction of the photosensitive drum 1, a position (corresponding to the above-described primary transfer portion T1 which is the contact portion with the intermediary transfer belt 7) on the photosensitive drum 1 where the primary transfer of the toner image onto the intermediary transfer belt 7 is carried out is a primary transfer position Pd. Further, with respect to the rotational direction of the photosensitive drum 1, a position (contact portion with the fur brush 62) on the photosensitive drum 1 where removal of the transfer residual toner is made by the fur brush 62 of the cleaning device 6 described later is a brush cleaning position Pe. Further, with respect to the rotational direction of the photosensitive drum 1, a position (contact portion with the cleaning blade 61) on the photosensitive drum 1 where removal of the transfer residual toner is made by the cleaning blade 61 of the cleaning device 6 described later is a blade cleaning position Pf With respect to the rotational direction of the photosensitive drum 1, the charging position Pa, the exposure position Pb, the developing position Pc, the primary transfer position Pd, the brush cleaning position Pe, and the blade cleaning position Pf are positioned in a named order from an upstream side toward a downstream side as viewed from the charging position Pa.

The image forming apparatus 100 includes a CPU 201 as a control means (controller) for controlling the image forming apparatus 100. To the CPU 201, a RAM 202 as a storing means used as a memory for operation and a ROM 203 as a storing means in which programs executed by the CPU 201 and various data are stored are connected. Further, to the CPU 201, a video controller 204 for processing image forming information inputted to the image forming apparatus 100 is connected. The video controller 204 for processing the image forming information processes the image forming information inputted from an external device (not shown) such as, a personal computer (PC) or an image reader, connected to the image forming apparatus 100. The CPU 201 controls the respective portion of the image forming apparatus 100 on the basis of image information processed and generated by the video controller 204. That is, the image forming apparatus 100 forms and outputs the toner image, corresponding to the image information inputted to the CPU 201, on the recording material P (print out).

2. Detailed Constitutions of Respective Portions

Next, detailed constitutions of the respective portions of the image forming apparatus 100 will be described. Incidentally, the cleaning device 6 will be specifically described later.

<Charging Device>

In this embodiment, as the charging means, the charging device 2 of a corona charging type was used. The charging device 2 of the corona charging type includes a discharge electrode and a grid electrode, and a high voltage is applied to the discharge electrode, so that the surface of the photosensitive drum 1 is electrically charged uniformly by utilizing a discharge phenomenon. In this embodiment, by the charging power source E1, for example, a voltage is applied to the discharging electrode so that a current of −1000 μA flows, and a voltage of −600 V is applied to the grid electrode. By this, the surface of the rotating photosensitive drum 1 is uniformly charged to a charge potential of about −500 V. In this embodiment, the charge potential of the photosensitive drum 1 has the negative polarity, and the surface of the photosensitive drum 1 is charged to the negative polarity side. Incidentally, the charge potential of the photosensitive drum 1 may be changed in conformity to a value of the developing bias, on the basis of an environment, a state of the image forming apparatus 100, or the like.

Incidentally, the charging means is not limited to the charging device of the corona charge type. For example, as the charging means, a contact-type charging roller contactable to the surface of the photosensitive drum 1 may be used. In this case, the surface of the photosensitive drum 1 is charged by utilizing the discharge phenomenon generating in a small gap between the photosensitive drum 1 and the charging roller. Further, in this case, to a core metal of the charging roller, a charging bias in a predetermined condition is applied. As this charging bias, an oscillating voltage in the superposed form of a DC component (DC bias) and an AC component (AC bias) can be used. For example, by setting the DC bias at −500 V and the AC bias at a peak-to-peak voltage value which is not less than twice a discharge start voltage in the case where the DC voltage is applied in the environment, the photosensitive drum 1 can be uniformly charged to about −500 V.

<Exposure Device)

In this embodiment, as the exposure device 3, the laser scanner was used. The exposure device 3 includes a semiconductor laser, and subject the photosensitive drum 1, of which surface is charged uniformly by the charging device 2, to image exposure on the basis of the image information. An exposure potential of the photosensitive drum 1 formed by irradiating the photosensitive drum surface with the laser light by the exposure device 3 is about −200 V.

Incidentally, in this embodiment, an example in which the semiconductor laser is used as the exposure means will be described, but another means such as an LED may also be used.

Further, a potential measuring means capable of measuring the surface potential of the photosensitive drum 1 after the exposure is disposed, and whether or not the charge potential and the exposure potential actually become predetermined potentials can be made so as to be capable of being checked.

<Developing Device>

In this embodiment, the developing device 4 of the reverse development type using a two-component developer was used as the developing means. The developing device 4 includes a developing container 42 in which as the developer, the two-component developer which is a mixture principally between non-magnetic toner particles (toner) and magnetic carrier particles (carrier) is accommodated. Further, the developing device 4 includes the developing sleeve 41 as a developer carrying member (developing member) provided rotatably at an opening of this developing container 42. In this embodiment, as the toner, negatively chargeable toner (negative toner) was used. In this embodiment, a length of the developing sleeve 41 with respect to a rotational axis direction is 325 mm. The developing sleeve 41 magnetically holds the developer in the developing container 42 by the action of a magnet (not shown) fixed and disposed inside the developing sleeve 41 and conveys the developer to a developing portion which is a gap portion with the photosensitive drum 1. In this embodiment, to the developing sleeve 41, by the developing power source E2, as the developing bias, an oscillating voltage in the superposed form of a DC component (DC bias) and an AC component (AC bias) is applied. For example, a developing bias in the superposed form of a DC bias of −400 V and an AC bias of 1600 V in Vpp is applied. By this developing bias, the development is carried out by deposition of the toner on the electrostatic latent image. Incidentally, a set value of the developing bias is an example and can be set at an appropriately adjusted value depending on the charge potential or the exposure potential of the photosensitive drum 1.

<Intermediary Transfer Belt>

In this embodiment, as the intermediary transfer member, the endless belt-shaped intermediary transfer belt 7 was used. In this embodiment, the intermediary transfer belt 7 includes three layers consisting of a resin layer, an elastic layer, and a surface layer in a named order from a beak surface side (inner peripheral surface side) toward a front surface side (outer peripheral surface side). As a resin material constituting the resin layer, a material such as polyimide or polycarbonate is used. A thickness of the resin layer may preferably be 70 μm or more and 100 μm or less. Further, as an elastic material constituting the elastic layer, a material such as an urethane rubber or a chloroprene rubber is used. A thickness of the elastic layer may preferably be 200 μm or more and 250 μm or less.

Further, as a material constituting the surface layer, a material capable of improving a secondary transfer property by decreasing a depositing force of the toner onto the surface of the intermediary transfer belt 7 may preferably be used. For example, one species of the resin material such as polyurethane, polyester, or epoxy resin, or two or more species of materials of elastic materials such as an elastic material rubber, elastomer, butyl rubber, and the like are used as a base material. Further, in this base material, one species or two or more species of materials for enhancing a lubricating property by decreasing surface energy, such as power or particles of fluorine-containing resin, or materials thereof made different in particle size can be dispersed and used. A thickness of the surface layer may preferably be 5 μm or more and 10 μm or less. In this embodiment, as the intermediary transfer belt 7, an intermediary transfer belt in which an electroconductive agent for adjusting an electric resistance value, such as carbon black is added and thus volume resistivity is $1\times10^{8}$ Ω·cm or more and $1\times10^{14}$ Ω·cm or less.

<Primary Transfer Roller>

In this embodiment, as the primary transfer means, the primary transfer roller 5 which is a roller prepared by molding a hydrin rubber elastic layer, adjusted in electric resistance, around a metal shaft was used. The primary transfer roller 5 is disposed in a position shifted to a downstream side with respect to the movement direction of the surface of the intermediary transfer belt 7 by about 2 mm from a position of a rotation center of the photosensitive drum 1, and is pressed toward the photosensitive drum 1 with a predetermined pressing force. To the primary transfer roller 5, the primary transfer bias is applied, so that the toner image is transferred from the photosensitive drum 1 onto the intermediary transfer belt 7. At that time, not only the toner but also the carrier in a small amount exist on the photosensitive drum 1 in some cases. As described above, by providing the elastic layer in the intermediary transfer belt 7, even when a hard material high in hardness such as the carrier is caught in the primary transfer portion T1, an effect such that damage on the photosensitive drum 1 in the primary transfer portion T1 is reduced can be obtained.

<Toner>

In this embodiment, the toner is triboelectrically charged to the negative polarity by rubbing with the carrier. In this embodiment, as the carrier, a carrier containing ferrite and having an average particle size of about 40 μm was used. Further, in this embodiment, as the toner, toner which is obtained by subjecting, to pulverization and classification, a kneaded product of a pigment and a wax component in a resin binder principally comprising polyester and which has an average particle size of about 6 μm was used. Further, in this embodiment, for the purposes of charge control, impartation of flowability, improvement in transfer property, and the like, on the surface layer of the toner, a plurality species of an external additive components (external additives) are deposited. In this embodiment, the external additive is triboelectrically charged to the positive polarity which is the opposite polarity to the normal charge polarity of the toner. In this embodiment, as the external additive component, in addition to silica and titanium oxide, inorganic fine particles which is 30 nm or more and 300 nm or less in average particle size of primary particles, which has at least one of a cubic particle shape and a rectangular parallelopiped particle shape, and which includes a perovskite-type crystal were externally added. In this embodiment, strontium titanate fine power was externally added as the inorganic fine particles including the perovskite-type crystal. The external additive component may preferably be added to toner particles in an amount of 0.05 wt. part or more and 2.00 wt. parts or less per 100 wt. parts of (final) toner particles before the external additive component is added to the toner particles, and in this embodiment, the strontium titanate fine powder was externally added in an amount of 0.5 wt. part. The strontium titanate fine powder used as the inorganic fine particles may more preferably be particles which are not subjected to a sintering step.

The strontium titanate fine powder includes at least one of the cubic particle shape and the rectangular parallelopiped particle shape and plays a role of polishing the surface of the photosensitive drum 1 when supplied to the cleaning portion of the photosensitive drum 1 by the cleaning device 6 described later. A material of the inorganic fine particles may be, other than the strontium titanate fine powder, barium titanate fine powder, calcium titanate fine powder, and the like.

The inorganic fine powder of the perovskite-type crystal is 30 nm or more and 300 nm or less in average particle size of primary particles, may preferably be 40 nm or more and 300 nm or less, more preferably be 40 nm or more and 250 nm or less. When this average particle size is less than 30 nm, there is a possibility that a polishing (abrasion) effect of the particles by the cleaning device 6 in the cleaning portion of the photosensitive drum 1 becomes insufficient. On the other hand, when the average particle size exceeds 300 nm, there is a possibility that the polishing effect is excessively strong and therefore scars occur on the surface of the photosensitive drum 1.

Further, the inorganic fine powder of the perovskite-type crystal is not always limited to inorganic fine powder existing as primary particles on surfaces of the toner particles, but exist as aggregate. Even in that case, when content of the aggregate having a particle size of 600 nm or more is 1 number (of particles) % or less, a good result can be obtained.

In the case where the inorganic fine powder contains particles and aggregate of 600 nm or more in an amount exceeding 1 number %, even when the primary particle size is less than 300 nm, there is a possibility that scars occur on the surface layer of the photosensitive drum 1.

Incidentally, the cleaning portion of the photosensitive drum 1 by the cleaning device 6 includes the blade cleaning position Pf which is the contact portion between the photosensitive drum 1 and the cleaning blade 61 and the brush cleaning position Pe which is the contact portion between the photosensitive drum 1 and the fur brush 62.

Here, an average particle size (number-average particle size) of the primary particles of the above-described inorganic fine particles (external additive) can be acquired by observing the inorganic fine particles existing on toner particle surfaces through a scanning electron microscope. As the scanning electron microscope, an Ultra-High Resolution Field Emission Scanning Electron Microscope ("S-4800", manufactured by Hitachi, Ltd.) can be used. Incidentally, elementary analysis of an energy dispersive X-ray analyzer (manufactured by EDAX Inc.) is made in advance, and then a material of an associated particle is checked, so that measurement can be performed. For example, in an enlarged field of view magnified by 50,000 times at the maximum, a long diameter of 100 primary particles of the inorganic fine particles are randomly measured, so that the number-average particle size can be acquired. An observation magnification can be appropriately adjusted depending on the size of the inorganic fine particles.

Further, an average particle size (weight-average particle size) of the above-described toner can be calculated by measuring the particle size of the toner by a precise particle size distribution measuring device ("Multisizer 3 Coulter Counter" (registered trademark), manufactured by Beckman Coulter, Inc.), according to a small-pore electric resistance method, provided with a 100 μm-aperture tube and a dedicated software ("Beckman Coulter Multisizer 3 Version 3.51", manufactured by Beckman Coulter, Inc.) included with the measuring device for measuring condition setting and measured data analysis, and then by performing the measured data analysis. Incidentally, it can be said that toner of about 4 μm or more and about 8 μm or less in average diameter is small-particle size toner.

<Photosensitive Drum>

In this embodiment, as the photosensitive member, the photosensitive drum 1 which is a negatively chargeable organic photoconductor (OPC) and which has a length of 360 mm and an outer diameter of 84 mm with respect to a rotational axis direction was used. In this embodiment, the photosensitive drum 1 is constituted by including an electroconductive substrate and a photosensitive layer which is formed thereon and which includes a photo-conductive layer principally comprising an organic photoconductor. The OPC is constituted in generally by laminating, on a metal substrate as the electroconductive substrate, a charge generating layer, a charge transporting layer, and a surface protective layer which are each formed of an organic material, in a named order. As the photosensitive drum 1 in this embodiment, for example, a photosensitive drum in which each of the above-described layers is formed of a material disclosed in JP-A 2005-43806 was used. Further, in this embodiment, the photosensitive drum 1 of a type in which the surface of the topmost layer is cured by using, for example, an electron beam irradiation provided ("EC150/45/40 mA", manufactured by IWASAKI ELECTRIC CO., LTD.).

An elastic deformation rate of the surface of the photosensitive drum 1 (for example, the photosensitive drum 1 of the type the surface of the topmost layer is cured by the above-described electron beam) may preferably be 48% or more and 65% or less. Further, a universal hardness value (HU) of the surface of this photosensitive drum 1 may preferably be 150 $N/mm^2$ or more and 220 $N/mm^2$ or less. In the case where the elastic deformation rate is smaller than the above-described range or in the case where the universal hardness value (HU) is smaller than the above-described range, scars are liable to occur on the surface of the photosensitive drum 1 or the like, so that lifetime extension becomes difficult. Further, in the case where the elastic deformation rate is larger than the above-described range or in the case where the universal hardness value (HU) is larger than the above-described range, an abrasion amount of the surface of the photosensitive drum 1 becomes excessively small, so that toner fusion of the surface of the photosensitive drum 1 is liable to occur.

Further, in this embodiment, during image formation, the photosensitive drum 1 is rotationally driven at a process speed (peripheral speed) of 400 mm/s in general by the driving device (not shown).

Here, the universal hardness value (HU) and the elastic deformation rate of the surface of the above-described photosensitive drum 1 are values measured (acquired by conducting a hardness test) by using a microhardness measuring device ("FISCHERSCOPE H100V", manufactured by FISCHER INSTRUMENTS K.K.) in an environment of a temperature of 23° C. and a relative humidity of 50% RH. This FISCHERSCOPE H100V is a device in which an indenter is contacted to a measuring object (peripheral surface of the photosensitive drum 1) and a load is continuously exerted on this indenter and in which hardness is continuously acquired by directly reading a pressing depth under the load. As the indenter, a Vickers quadrangular pyramid diamond indenter with an angle between opposite faces of 6° was used, and the indenter was pressed against the peripheral surface of the photosensitive drum 1. A final load continuously exerted on the indenter was set at 6 mN, and a time (retention time) in which a state in which the final load of 6 mN was exerted on the indenter was retained was 0.1 sec. Further, the number of measuring points was 273 points.

Figure 3:
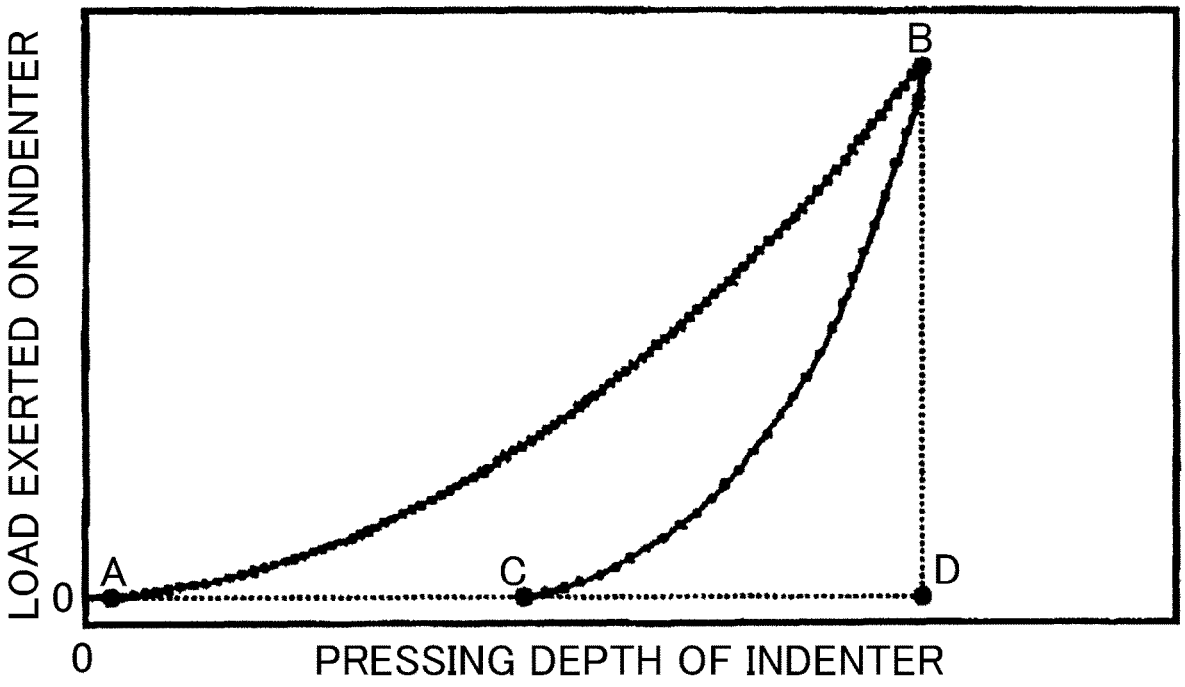
FIG. 3 is a graph of an output chart of a FISCHERSCOPE H100V (manufactured by FISCHER INSTRUMENTS K.K.).
Figure 4:
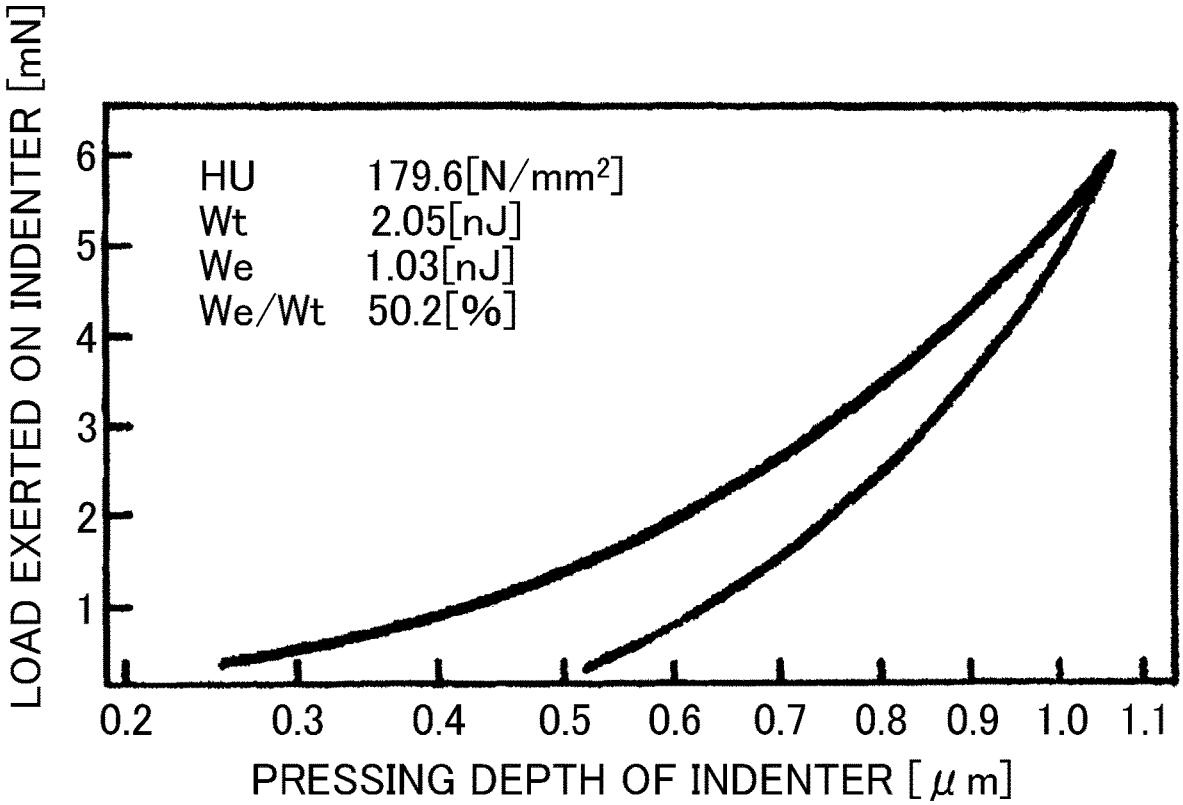
FIG. 4 is a graph of an example of the output chart of the FISCHERSCOPE H100V.

FIG. 3 is a graph showing an outline of an outline chart of the FISCHERSCOPE H100V. Further, FIG. 4 is a graph showing an example of the output chart of the FISCHERSCOPE H100V when the photosensitive drum 1 in this embodiment is a measuring object. In FIGS. 3 and 4, the ordinate represents a load F [mN] exerted on the indenter, and the abscissa represents a pressing depth [μm] of the indenter. FIG. 3 shows a result when the load becomes maximum by increasing stepwise the load exerted on the indenter (A→B) and then the load is decreased stepwise (B→C). FIG. 4 shows a result when the load exerted on the indenter is increased stepwise up to 6 mN finally and then the load is decreased stepwise.

Further, the universal hardness value (HU) can be acquired by a formula shown below from the above-described pressing depth when the final load 6 mN is exerted on the indenter. Incidentally, in the formula shown below, "HU" represents the universal hardness value, "Ft" represents the final load, "$S_f$" represents a surface area of a portion in which the indenter is pressed when the final load is exerted on the indenter, and "$h_f$" represents the pressing depth of the indenter when the final load is exerted on the indenter.

$$HU=F_f(N)/S_f(mm^2)=6\times10^{-3}/\{26.43\times(h_f\times10^{-3})^2\}$$

Further, the elastic deformation rate can be acquired from workload (energy) done for the measuring object (the peripheral surface of the photosensitive drum 1) by the indenter, i.e., from a change in energy due to an increase and a decrease of the load on the measuring object (the peripheral surface of the photosensitive drum 1 by the indenter. Specifically, a value obtained by dividing an elastic deformation workload We by total workload Wt (We/Wt) is the elastic deformation rate. Incidentally, the total workload Wt is an area of a region enclosed by A-B-D-A in FIG. 3, and the elastic deformation workload We is an area of a region enclosed by C-B-D-C. These surface layer characteristics of the photosensitive drum 1 can be represented by a measurement result of the photosensitive drum 1 in an initial stage of use (in a fresh state).

3. Cleaning Device

<General Structure and Operation of Cleaning Device>

Figure 5:
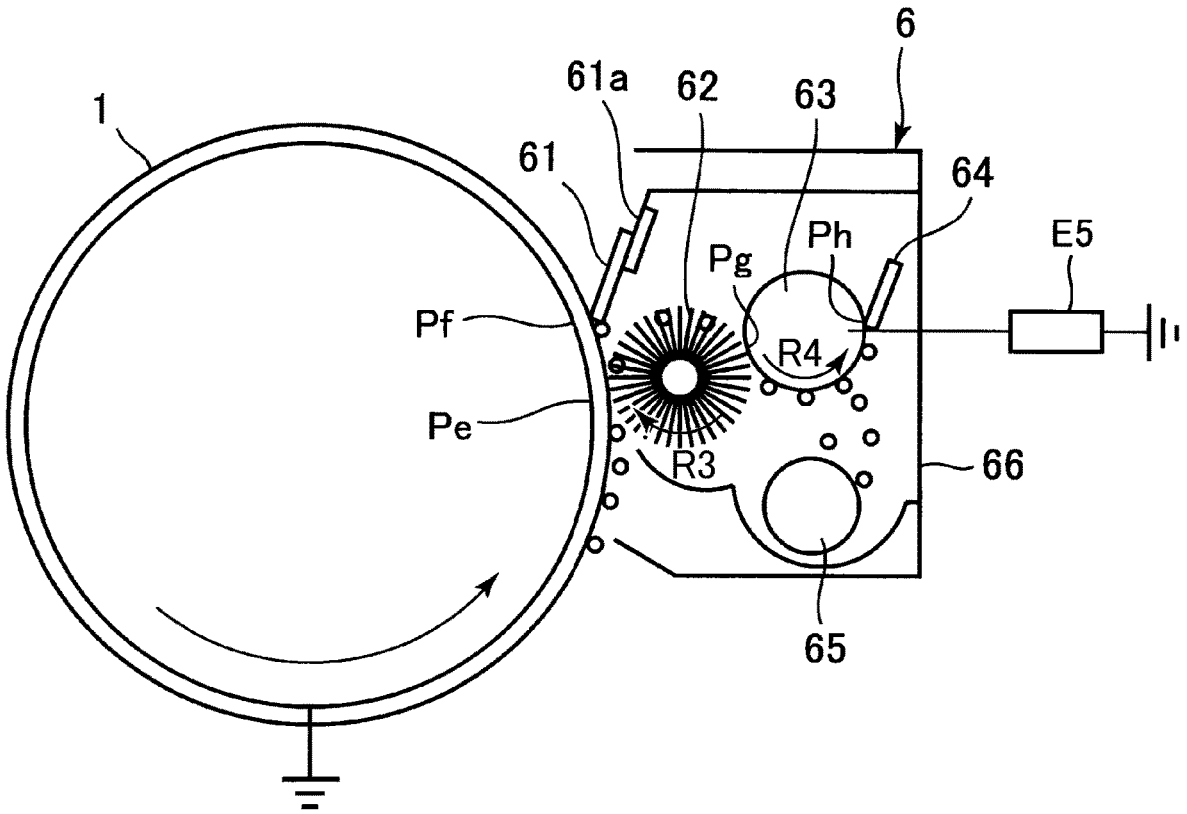
FIG. 5 is a schematic sectional view of a cleaning device and a periphery thereof in an embodiment 1.

Next, the cleaning device 6 in this embodiment will be described further specifically. FIG. 5 is a schematic sectional view of the cleaning device 6 and a periphery thereof in this embodiment.

The cleaning device 6 includes a housing 66. Further, the cleaning device 6 includes a fur brush (electroconductive fur brush roller) 62 which is a rotatable roller-shaped brush having electroconductivity. The fur brush 62 functions not only as a toner scraping means (cleaning member) for scraping the toner off the photosensitive drum 1 but also as a recording material polishing means (polishing member) for polishing (abrading) the surface of the photosensitive drum 1. Further, the fur brush 62 constitutes an auxiliary cleaning means (auxiliary cleaning member) for assisting removal of the toner from the surface of the photosensitive drum 1 by a cleaning blade 61 described later. The fur brush 62 is rotatably supported by the housing 66. A rotational axis direction of the fur brush 62 is substantially parallel to the rotational axis direction of the photosensitive drum 1. The fur brush 62 is provided so as to contact the surface of the photosensitive drum 1. In this embodiment, the fur brush 62 is disposed so that a penetration amount into the surface of the photosensitive drum 1 is 0.7 mm. Here, the penetration amount can be represented by a value obtained by subtracting a distance (shortest distance) between a base material on a rotation shaft of the fur brush 62 described later and the photosensitive drum 1 from a length of brush fibers described later. To the fur brush 62, a driving force is transmitted from a driving motor as a driving source while the fur brush 62 contacts the surface layer of the photosensitive drum 1, so that the fur brush 62 is rotationally driven at a predetermined rotational speed (peripheral speed in the case where the brush fibers are not deformed by an external force) in an arrow R3 direction (clockwise direction) in FIG. 5. That is, the fur brush 62 is rotationally driven so as to move in the same direction as the photosensitive drum 1 in a contact portion between itself and the photosensitive drum 1. Incidentally, to the fur brush 62, the driving force may be transmitted from a dedicated driving source or may also be branched and then transmitted from a driving source for another rotatable member, such as the driving source for the photosensitive drum 1. Further, in this embodiment, the fur brush 62 is rotationally driven at a peripheral speed faster than the peripheral speed (surface movement speed) of the photosensitive drum 1. In this embodiment, the fur brush 62 is rotationally driven of the peripheral speed which is 110% of the peripheral speed of the photosensitive drum 1.

Further, the cleaning device 6 includes the cleaning blade (elastic cleaning blade) 61 which is a plate-like (blade-like) member formed of an elastic material. The cleaning blade 61 functions not only as a toner scraping means (cleaning member) for scraping the toner off the photosensitive drum 1 but also as a photosensitive member polishing means (polishing member) for polishing (abrading) the surface of the photosensitive drum 1. The cleaning blade 61 is fixed by an adhesive bonding or the like to a supporting member 61*a* formed with a metal plate or the like, and this supporting member 61*a* is fixed to the housing 66, so that the cleaning blade 61 is supported by the housing 66. A longitudinal direction of the cleaning blade 61 is substantially parallel to the rotational axis direction of the photosensitive drum 1. The cleaning blade 61 is provided so as to contact the surface of the photosensitive drum 1 at a contact portion (blade cleaning position Pf) downstream of the contact portion (brush cleaning position Pe) between the fur brush 62 and the photosensitive drum 1. The cleaning blade 61 is disposed so that an edge portion (on the photosensitive drum 1 side) of a free end portion thereof which is one end portion with respect to a widthwise direction substantially perpendicular to the longitudinal direction is contacted to the photosensitive drum 1 at a predetermined pressure. Further, the cleaning blade 61 contacts the photosensitive drum 1 in a direction counter to the rotational direction of the photosensitive drum 1 so that a fixed end portion which is the other end portion thereof with respect to the widthwise direction is positioned on a side upstream of the above-described free end portion with respect to the rotational direction of the photosensitive drum 1.

Further, the cleaning device 6 includes a collecting roller 62 which is a rotatable roller-like member having electroconductivity. The collecting roller 63 functions not only as a collecting means (collecting member) for collecting the toner from the fur brush 62 but also as a voltage applying means (voltage applying member, electroconductive member) for applying a voltage to the fur brush 62. The collecting roller 63 is rotatably supported by the housing 66. A rotational axis direction of the collecting roller 63 is substantially parallel to the rotational axis direction of the fur brush 62. The collecting roller 63 is disposed so as to contact the fur brush 62 on a side downstream of the contact portion between the fur brush 62 and the photosensitive drum 1 with respect to the rotational direction of the fur brush 62. A contact portion between the fur brush 62 and the collecting roller 63 with respect to the rotational direction of the collecting roller 63 is a collecting position Pg. To the collecting roller 63, a driving force is transmitted from a driving motor as a driving source while the collecting roller 63 contacts the fur brush 62, so that the collecting roller 63 is rotationally driven at a predetermined rotational speed in an arrow R4 direction (counterclockwise direction) in FIG. 5. That is, the collecting roller 63 is rotationally driven so as to move in the same direction as the fur brush 62 in a contact portion between itself and the fur brush 62. Incidentally, to the collecting roller 63, the driving force may be transmitted from a dedicated driving source or may also be branched and then transmitted from a driving source for another rotatable member, such as the driving source for the collecting roller 63. Further, in this embodiment, the collecting roller 63 is rotationally driven at a peripheral speed faster than the peripheral speed of the fur brush 62. In this embodiment, the collecting roller 63 is rotationally driven of the peripheral speed which is 105% of the peripheral speed of the fur brush 62.

Further, the cleaning device 6 includes the scraper member 64 which is a plate-like (blade-like) member formed of an elastic material. The scraper member 64 functions as a removing means (removing member) for removing the toner on the collecting roller 63. The collecting roller 63 is supported by the housing 66. Incidentally, similarly as the cleaning blade 61, the scraper member 64 may be supported by the housing 66 via a supporting member. A longitudinal direction of the scraper member 64 is substantially parallel to the rotational axis direction of the collecting roller 63. The scraper member 64 is provided so as to contact the surface of the collecting roller 63 on a side downstream of the contact portion (collecting position Pg) between the collecting roller 63 and the fur brush 62. A contact portion between the collecting roller 63 and the scraper member 64 with respect to the rotational direction of the collecting roller 63 is a removal position Ph. The scraper member 64 is disposed so that an edge portion (on the collecting roller 63 side) of a free end portion thereof which is one end portion with respect to a widthwise direction substantially perpendicular to the longitudinal direction is contacted to the collecting roller 63 at a predetermined pressure. Further, the scraper member 64 contacts the collecting roller 63 in a direction counter to the rotational direction of the collecting roller 63 so that a fixed end portion which is the other end portion thereof with respect to the widthwise direction is positioned on a side upstream of the above-described free end portion with respect to the rotational direction of the collecting roller 63.

Further, the cleaning device 6 includes a feeding screw 65 as a feeding means. The feeding screw 65 is provided below the scraper member 64 with respect to a direction of gravitation. The feeding screw 65 feeds the toner, collected in the housing 66, along the rotational axis direction of the photosensitive drum 1, for example, from a front side on the drawing sheet toward a rear side in FIG. 5.

To the collecting roller 63, a cleaning power source E5 as an applying means constituting a potential switching means for the fur brush 62 is connected. Further, by the cleaning power source E5, a cleaning bias (cleaning voltage) can be applied to the collecting roller 63. It can be regarded that the cleaning power source E5 also constitutes the cleaning device 6. The cleaning power source E5 is connected to the CPU 201 for controlling a timing of bias application and a bias value (potential) to be applied. In this embodiment, during removal of the toner from the surface of the photosensitive drum 1, the cleaning bias which is a DC voltage of the positive polarity (+) opposite to the normal charge polarity of the toner is applied to the collecting roller 63 by the cleaning power source E5. During the removal of the toner refers to during passage of an image forming region (region in which the toner image is capable of being formed) on the surface of the photosensitive drum 1 with respect to the surface movement direction of the photosensitive drum 1, which region is defined correspondingly to the recording material P passes through the brush cleaning position Pe. As described later specifically, as a material of the fur brush 62, an electroconductive material such as electroconductive fibers is used.

Further, the fur brush 62 contacts the collecting roller 63 to which the cleaning bias is applied, so that the potential thereof becomes a potential somewhat smaller in absolute value than the cleaning bias applied to the collecting roller 63. Thus, the potential of the fur brush 62 becomes the potential of the positive polarity opposite to the normal charge polarity of the toner. By this, the toner on the surface of the photosensitive drum 1 is caught not only mechanically but also electrostatically by the fur brush 62 rubbing the surface of the photosensitive drum 1. For that reason, cleaning efficiency is further improved. Thus, at least a part of the toner on the surface of the photosensitive drum 1 is collected by the fur brush 62 before reaches the cleaning blade 61.

The toner moved from the surface of the photosensitive drum 1 to the fur brush 62 in the contact portion between the photosensitive drum 1 and the fur brush 62 is moved to the collecting roller 63 by a potential difference between the fur brush 62 and the collecting roller 63 in the contact portion between the fur brush 62 and the collecting roller 63. That is, the potential of the collecting roller 63 is somewhat larger than the potential of the fur brush 62 in terms of an absolute value on a side opposite to the normal charge polarity. By this, at least a part of the toner collected by the fur brush 62 is electrostatically moved to the collecting roller 63. The toner moved to the collecting roller 63 in the contact portion between the fur brush 62 and the collecting roller 63 is scraped off the surface of the collecting roller 62 by the scraper member 64 in the contact portion between the collecting roller 63 and the scraper member 64. The toner scraped off the surface of the collecting roller 63 by the scraper member 64 drops by gravitation.

Further, the toner on the surface of the photosensitive drum 1 which was not collected by the fur brush 62 is scraped off the surface of the photosensitive drum 1 by the cleaning blade 61 and is accommodated in the housing 66.

The thus-collected toner in the housing 66 is fed by the feeding screw 65 disposed at a lower portion (bottom) of the housing 66 and is discharged to an outside of the housing 66.

Then, this toner is conveyed toward a collecting container (not shown) provided inside an apparatus main assembly or the like of the image forming apparatus 100.

Incidentally, in this embodiment, the application of the cleaning bias to the collecting roller 63 is started in synchronism with a timing when the charging device 2 starts drive (the charging process of the surface of the photosensitive drum 1) after the start of rotation of the photosensitive drum 1.

<Cleaning Blade>

The cleaning blade 61 in this embodiment is made of an urethane rubber and is 340 mm in length with respect to a longitudinal direction, and is contacted to the photosensitive drum 1 at a predetermined pressure. From a viewpoint of a cleaning property, a preferred physical property of the cleaning blade 61 is as follows. Hardness (IRHD) may preferably be in a range of 65° or more and 850 or less. Further, rebound resilience coefficient in an environment of 25° C. may preferably be in a range of 15% or more and 60% or less. Further, an elongation at break in a tensile test is 300% or less. Further, Young's modulus may preferably be in a range of 50 kg/cm$^2$ or more and 200 kg/cm$^2$ or less. Further, 100%-modulus may preferable be in a range of 4.0 MPa or more and 9.0 MPa or less.

Incidentally, it is more preferable that the hardness (IRHD) is 700 or more and 800 or less, the elongation at break is 250% or less, and the rebound resilience coefficient at 25° C. is 15% or more and 35% or less.

Measuring methods of the above-described physical properties are as follows. The hardness (IRHD) for the prepared cleaning blade 61 was measured on the basis of JIS K6253 by using a hardness tester manufactured by H.W. Wallace & Co., Limited. The 100%-modulus for the prepared cleaning blade 61 was measured on the basis of JIS K6251 by using a tensile testing machine ("UNITRON TS-3013", manufactured by Ueshima Seisakusho Co., Ltd.). Further, the elongation at break in the tensile test for the prepared cleaning blade 61 was measured on the basis of JIS K6251 by using the tensile testing machine ("UNITRON TS-3013", manufactured by Ueshima Seisakusho Co., Ltd.).

The rebound resilience for the prepared cleaning blade 61 was measured on the basis of JIS K6255 in the environment of 25° C. by using a Lupke Rebound Resilience Tester manufactured by Ueshima Seisakusho Co., Ltd. Further, the Young's modulus for the prepared cleaning blade 61 was measured on the basis of JIS K 6251 by using the tensile testing machine ("UNITRON TS-3013", manufactured by Ueshima Seisakusho Co., Ltd.).

<Fur Brush>

The fur brush 62 which is the rotatable member is constituted by planting fibers on a rotation shaft. In this embodiment, the fur brush 62 is prepared by winding a fiber-planted cloth material (base material) about a metal rotation shaft of 12.1 mm in diameter. As an example, fibers (brush fibers) of the fur brush 62 are those prepared by planting bundles of acrylic filaments of 6 denier in thickness on the base material at a bristle (brush) density of 70 kF/inch$^2$ (bristle density per filament). Further, as an example, an outer diameter of entirety of the fur brush 62 (outer diameter in the case where the brush fibers are not deformed by the external force) is 21.4 mm. Further, a length of the brush fibers obtained by subtracting a diameter (12.1 mm) of a core metal and a thickness (0.15 mm×2) of the base material from the outer diameter is 4.5 mm. Further, in this embodiment, as the brush fibers, electroconductive fibers adjusted in electric resistance of the fibers by dispersing carbon black in a certain amount in a base material of the fibers were used. From the viewpoint of the cleaning property or the like, preferred physical properties of a filament tensile strength of the brush fibers in an environment of a temperature of 23° C. and a relative humidity of 50% RH (herein, this tensile strength is simply referred to as a "brush fiber tensile strength") may preferably be 40 cn/dtex or more and 80 cn/dtex or less. When this brush fiber tensile strength is less than 40 cn/dtex, due to early bristle falling of the fibers, there is a possibility that the toner cannot be collected by the fur brush 62 and thus improper cleaning occurs. Further, when the brush fiber tensile strength exceeds 80 cn/dtex, the surface of the photosensitive drum 1 is damaged with respect to a circumferential direction of the photosensitive drum 1 and thus an image defect occurs. Further, an electric resistance of the fur brush 62 may preferably be 10

Log Ω or more and 12 Log Ω or less in the environment of the image of 23° C. and the relative humidity of 50% RH. When this electric resistance is less than 10 Log Ω, there is a possibility that an excessive current flows from the fur brush 62 into the photosensitive drum 1 and thus an image defect due to a drum memory (phenomenon that a potential history is not eliminated but remains) occurs. Further, when the electric resistance exceeds 12 Log Ω, there is a possibility that sufficient current does not flow through the fur brush 62 and thus the toner cannot be collected by the fur brush 62.

Measuring methods of the above-described physical properties are as follows. The filament tensile strength of the brush fibers in the environment of 23° C. and 50% RH was measured in conformity to "Testing methods for woven and knitted fabrics" (JIS L 1096:2010). Further, the electric resistance of the fur brush 62 was measured in the following manner by using a self-made measuring apparatus (manufactured by Canon Inc.). That is, the fur brush 61 was contacted to a metal roller under a condition of a penetration depth of 1 mm, and a current flowing through the fur brush 62 when the fur brush 62 was rotated under application of a voltage of 400 V was detected, so that an electric resistance value of the fur brush 62 was measured.

Incidentally, a condition of the fur brush 62 capable of suppressing an occurrence of the toner fusion on the surface of the photosensitive drum 1 while achieving lifetime extension of the photosensitive drum 1 will be described later further specifically.

<Collection Roller>

In this embodiment, as the collecting roller 63, a solid metal roller made of SUS (stainless steel) in an outer diameter of φ13 mm was used.

<Scraper Member>

As a material of the scraper member 64, it is possible to cite a nylon-based sheet material, a polyurethane rubber blade, and the like. In this embodiment, a material which is substantially same as the material of the above-described cleaning blade 61 was used.

4. Rigidity Characteristic of Fur Brush and Surface Layer Characteristic of Photosensitive Drum Next, a relationship between the condition of the fur brush and the surface layer of the photosensitive drum 1, and a constitution in which the toner fusion can be suppressed by appropriately abrading the surface of the photosensitive drum 1 while achieving the lifetime extension of the photosensitive drum 1 by suppressing an occurrence of scars on the surface of the photosensitive drum 1 will be described.

<Occurrence of Toner Fusion and Suppression Thereof>

Figure 6:
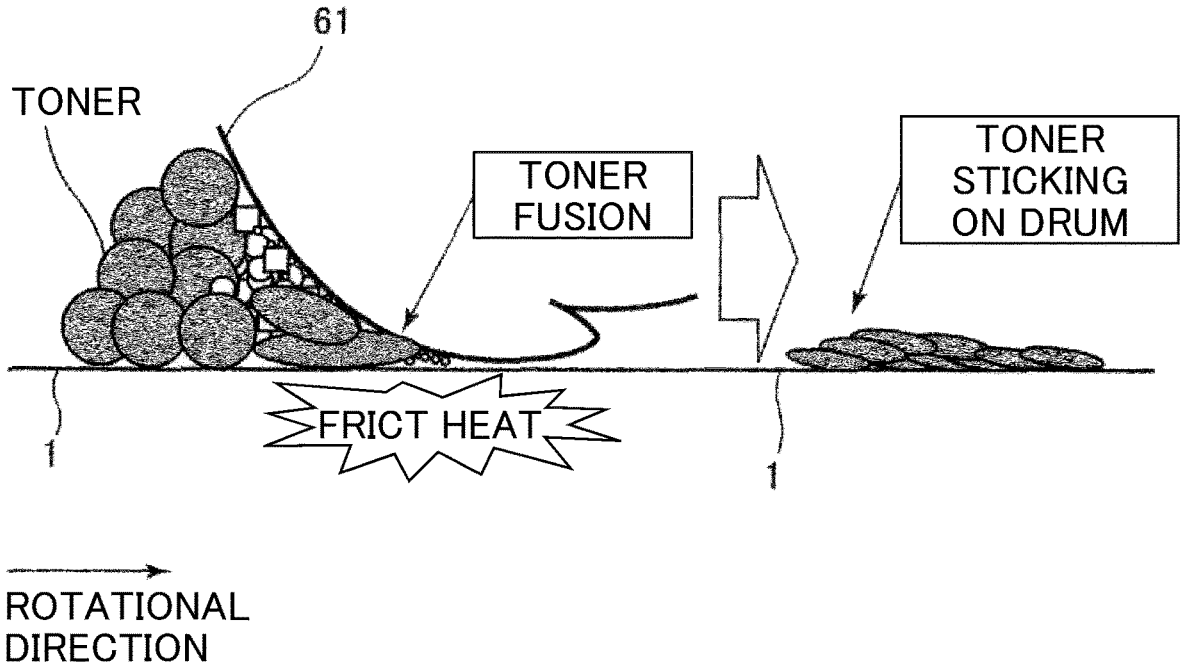
FIG. 6 is a schematic view for illustrating an occurrence process of toner fusion.
Figure 7:
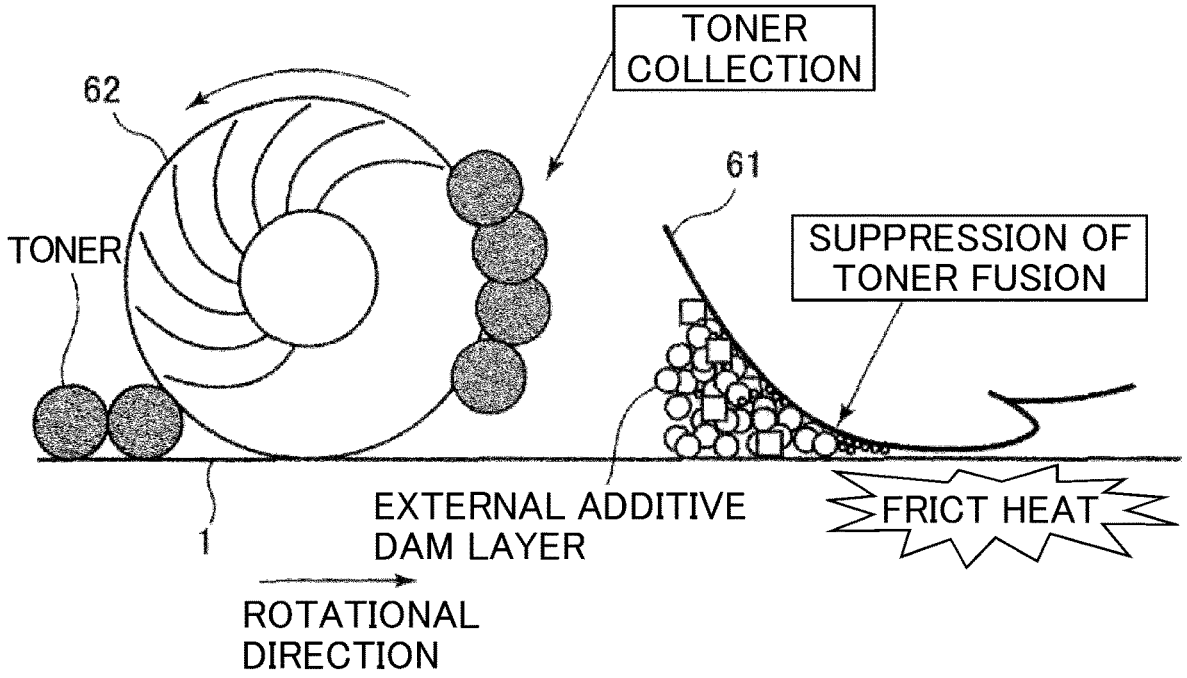
FIG. 7 is a schematic view for illustrating a toner fusion suppression effect.

First, a toner fusion suppressing effect by the fur brush 62 capable of applying a bias in this embodiment will be described. FIG. 6 is a schematic view for illustrating an occurrence process of the toner fusion. FIG. 7 is a schematic view for illustrating the toner fusion suppressing effect by the fur brush 62 capable of applying the bias in this embodiment.

As shown in FIG. 6, the photosensitive drum 1 is rubbed with (abraded by) the cleaning blade 61 contacted to the photosensitive drum 1, whereby a temperature in the neighborhood of a contact portion between the cleaning blade 61 and the photosensitive drum 1 (herein, this contact portion is also referred to as a "blade nip") increases. As a result, the toner presents in the neighborhood fuses and sticks onto the photosensitive drum 1. The toner fusion is a phenomenon which occurs in such a manner.

Originally, in the neighborhood of the blade nip, a deposited matter of an external additive for the toner (herein, also referred to as an external additive dam layer) (FIG. 7) is formed, so that entrance of the toner into the blade nip is suppressed. As a result, temperature rise of the toner is suppressed, and thus the toner fusion does not occur.

However, a small-size toner depending on the quality improvement in recent years is high in flowability and thus is liable to break the above-described external additive dam layer (FIG. 6). Further, by the speed-up of the process speed, frictional heat generated by the cleaning blade 61 is also liable to rise, so that there is a tendency that the toner fusion is liable to occur.

Therefore, in this embodiment, as shown in FIG. 7, the toner is collected before the toner reaches the external additive dam layer by disposing the fur brush 62, to which the bias is applicable, upstream of the cleaning blade 61 with respect to the movement direction of the surface of the photosensitive drum 1. As a result, the external additive dam layer is stably maintained, so that the occurrence of the toner fusion is suppressed. In this embodiment, to the electroconductive fur brush 62, by applying a cleaning bias of +300 V of the opposite polarity to the normal charge polarity of the toner, the toner is collected by the fur brush 62. Thus, by providing the fur brush 62 to which the bias is applicable, the occurrence of the toner fusion can be suppressed to the extent possible. However, even in the case where the fur brush 62 to which the bias is applicable is provided, in a long-term use of the photosensitive drum 1 of which lifetime is prolonged, it becomes important that in the case where the toner fusion occurs, growth (accumulation) thereof can be appropriately suppressed.

On the other hand, conventionally, with respect to the movement direction of the surface of the photosensitive drum, the fur brush is disposed upstream of the cleaning blade so as to contact the photosensitive drum, and the surface of the photosensitive drum is mechanically polished together with the deposited matter. Such a method has been used. However, in order to improve a polishing force by the fur brush, when rigidity of the fur brush is increased, although the toner fusion is suppressed, the photosensitive drum is excessively abraded, so that there arises a problem such as shortened lifetime.

Thus, occurrence itself of the toner fusion is suppressed by stably maintaining the external additive dam layer through enhancement in toner collecting property of the fur brush 62 under application of the bias, and the appropriate polishing of the surface of the photosensitive drum 1 is enabled without making the rigidity of the fur brush 62 excessively high, so that it has been desired that the growth of the toner fusion is suppressed by suppressing the shortened lifetime of the photosensitive drum 1.

<Relationship Between Condition of Fur Brush and Surface Layer of Photosensitive Drum>

It turned out that an abrasion amount of the surface layer of the photosensitive drum 1 and occurrence or non-occurrence of the toner fusion are influenced by a condition of the fur brush 62.

First, abrasion of the surface layer of the photosensitive drum 1 and polishing of the deposited matter on the surface of the photosensitive drum 1 change depending on prescription of the fur brush 62. Therefore, fur brushes 62 changed in tensile strength, thickness, length, and bristle density of the brush fibers were prepared, and a relationship thereof with the abrasion of the surface layer of the photosensitive drum 1 was checked. Incidentally, a penetration amount of the fur brush 62 into the photosensitive drum 1 was made constant.

Here, a brush rigidity index can be calculated as an index of hardness of the fur brush 62 relative to the photosensitive drum 1 from a tensile strength A [cn/dtex] of the brush fibers, a thickness B [denier] of the brush fibers, a bristle density C [kF/inch$^2$] of the brush fibers, and a length D [mm] of the brush fibers. This brush rigidity index [no unit] is specifically represented by the following formula (1).

$$\text{(Brush rigidity index)}=A\times B^2\times C/D^2 \quad (1)$$

This brush rigidity index of the formula (1) is calculated by multiplying the strength of the brush fibers and the contact area of the brush fibers. As regards the rigidity itself of the brush fibers, it was able to be checked that when the rigidity was checked while changing the brush fiber thickness and the brush fiber length, the rigidity increased with a shorter brush fiber length and with a larger brush fiber thickness. It can be said that with a larger brush rigidity index of the above-described formula (1), a harder fur brush 62 occurs the photosensitive drum 1 and thus an abrasion ratio of the surface layer of the photosensitive drum 1 becomes larger. Further, with the larger brush rigidity index of the above-described formula (1), it can be said that removing power of the deposited matter on the surface of the photosensitive drum 1 is higher.

On the other hand, also as regards the photosensitive drum 1 contacting the fur brush 62, photosensitive drums 1 changed in hardness and an elastic deformation rate E of the surface layer were prepared and the abrasion of the surface layer when each of the photosensitive drums 1 contacts the fur brush 62 was checked under a plurality of conditions. As a result, it turned out that the elastic deformation rate largely correlates with the surface layer abrasion and the toner fusion.

It can be said that the brush rigidity index ($=A\times B^2\times C/D^2$) and the elastic deformation rate (=E) are both the index of hardness. For that reason, when the ratio falls within a certain range, the surface layer abrasion of the photosensitive drum 1 in the case where the fur brush 62 with certain rigidity is disposed can be caused to fall within an appropriate range. That is, it is possible to suppress that the toner fusion occurs due to an excessively small abrasion amount of the surface layer of the photosensitive drum 1 and that the surface of the photosensitive drum 1 is excessively abraded due to an excessively large abrasion amount of the surface layer of the photosensitive drum 1 and thus the lifetime of the photosensitive drum 1 is shortened or the like.

<Experimental Examples>

The following experiment was conducted by changing the brush rigidity index ($=A\times B\times C/D^2$), the elastic deformation rate (=E) of the photosensitive drum 1, and a voltage applied to the brush (brush application voltage) (cleaning bias). That is, when images were formed on 500,000 sheets in a high temperature/high (relative) humidity environment (30° C./80% RH), surface states such as surface abrasion and surface roughness of the photosensitive drum 1 and an occurrence of an image defect due to the toner fusion were checked. Incidentally, in this case, evaluation was performed by using the image forming portion 10K for black.

When the surface abrasion of the photosensitive drum 1 progresses, a black streak occurs on the sheet (paper) on which the image is formed. The case where the black streak occurred on the sheet during formation of the images on 500,000 sheets was evaluated as "poor (x)", and the case where the black streak did not occur was evaluated as "good (o)". Further, when the toner fusion progresses, a white void portion (white void) occurs on a solid black image on the sheet during the formation of the images on 500,000 sheets. The case where a white void of 2 mm or more in size (maximum diameter) occurred on the solid black image on the sheet during the formation of the images on 500,000 sheets was evaluated as "poor (x)", and the case where the white void did not occur was evaluated as "good (o)".

A result thereof is shown in FIGS. 8A and 8B. As an example, a result in which the elastic deformation rate E of the photosensitive drum 1 was changed to 5 kinds of 45%, 48%. 55%. 60%, and 62% while using the brush application voltage=0 V, the brush fiber tensile strength A=80 cn/dtex of the fur brush 62, the brush fiber thickness B=6 denier, the brush fiber bristle density C=75 kF/inch$^2$, and the brush fiber length D=4.5 mm will be described (experiment Nos. 1 to 5). The images were formed on 500,000 sheets for each of the photosensitive drums with the respective elastic deformation rates, and then the abrasion of the surface layer of the photosensitive drum 1 and occurrence or non-occurrence of the toner fusion were checked. As a result, in the case where the elastic deformation rate of the photosensitive drum 1 is 45%, the image defect occurred at the time exceeding about the time of 480,000 sheets. This would be considered because the rigidity of the photosensitive drum 1 is small and the surface layer of the photosensitive drum 1 is excessively abraded. Further, in the case where the elastic deformation rate of the photosensitive drum 1 is 48% or more, the toner fusion occurred. This would be considered because the rigidity of the photosensitive drum 1 is large, and a polishing (abrasion) amount of the surface layer of the photosensitive drum 1 becomes small.

Next, under application of brush application voltage=0 V, similar experiments were conducted while changing the brush rigidity index through changes in the brush fiber thickness B, the brush fiber bristle density C, and the brush fiber length D (experiment Nos. 6 to 25). As a result, it turned out that under the brush application voltage=0 V, the toner fusion can be prevented from occurring by increasing the brush rigidity index but the surface layer abrasion of the photosensitive drum 1 occurs early. That is, a condition capable of compatibly suppressing the image defect due to excessing abrasion and suppressing the toner fusion was not able to be set.

On the other hand, by applying the cleaning bias (+300 V in this embodiment) to the fur brush 62 (experiment Nos. 26 to 41) it became possible to suppress the toner fusion without increasing the brush rigidity index (for example, experiment Nos. 27 to 29). Further, by applying the cleaning bias (+300 V in this embodiment) to the fur brush 62 (experiment Nos. 26 to 41), the brush rigidity index was able to be sufficiently lowered, and thus it became possible to suppress the occurrence of the image defect due to the excessive abrasion of the surface layer of the photosensitive drum 1. That is, it became possible to compatibly realize the suppression of the toner fusion and the lifetime extension of the photosensitive drum 1 (for example, experiment Nos. 27 to 29).

Incidentally, in experiment Nos. 31 to 34, the brush rigidity index was changed in a range of 3.6 mm to 4.5 mm of the brush fiber length D. In these experiments, a good result was obtained in a range of 4.2 mm to 4.5 mm of the brush fiber length D. Further, in experiment Nos. 35 to 38, the brush rigidity index was changed by setting the brush fiber tensile strength at 40 cn/dtex and by changing the fur brush thickness B in a range of 6 to 18 denier. In these experiments, a good result was obtained in a range of 6 to 15 denier of the brush fiber thickness B. Further, in experiment Nos. 39 to 41, the brush rigidity index was changed by setting the brush fiber tensile strength at 40 cn/dtex and by changing the brush fiber bristle density C in a range of 30 to 75 kF/inch$^2$. In these experiments, a good result was obtained in a range of 30 to 45 KF/inch$^2$ of the brush fiber bristle density C. Incidentally, in the experiment Nos. 31 to 41, evaluation was performed under a condition such that the elastic deformation rate E of the photosensitive drum 1 is 48% and thus the photosensitive drum 1 is relatively abraded easily.

Further, when the brush rigidity index is excessively small, bristles of the fur brush 62 fall and cannot properly contact the photosensitive drum 1, with the result that it is understood that the toner cannot be collected before the toner reaches the cleaning blade 61. By study of the present inventor, it is understood that such a problem can be sufficiently solved when the brush rigidity index is 400 or more.

From the result shown in FIGS. 8A and 8B, by satisfying the following condition formulas:

$$48(\%) \leq E \leq 60(\%), \text{ and}$$

$$400 \leq \{A \times B^2 \times C/D^2\} \leq 20408,$$

it is understood that the following effect can be obtained. That is, while suppressing the shortened lifetime of the photosensitive drum 1 due to excessive abrasion of the surface layer of the photosensitive drum 1, it is also possible to suppress the occurrence of the toner fusion due to excessively small abrasion of the surface layer of the photosensitive drum 1. Further, in order to realize the suppression of the occurrence of the toner fusion while suppressing the shortened lifetime of the photosensitive drum 1, it is preferable that $400 \leq \{A \times B^2 \times C/D^2\} \leq 14000$ is satisfied, and it is more preferable that $400 \leq \{A \times B^2 \times C/D^2\} \leq 10000$ is satisfied.

Thus, in the case where the cleaning bias is applied to the fur brush 62, by determining the brush rigidity index ($=A \times B^2 \times C/D^2$) and the elastic deformation rate (=E) of the photosensitive drum 1 so as to satisfy the above-described condition formulas, the shortened lifetime of the photosensitive drum 1 and the occurrence of inconveniences such as the toner fusion can be suppressed. That is, the fur brush 62 under a proper condition in conformity to surface hardness of the photosensitive drum 1 is contacted to the photosensitive drum 1, whereby it is possible to suppress the occurrence of the image defect such as the toner fusion on the surface of the photosensitive drum 1 without excessively abrading the surface of the photosensitive drum 1. That is, according to this embodiment, occurrence itself of the toner fusion is suppressed by stably maintaining the external additive dam layer by enhancing the toner cleaning property of the fur brush 62 under application of the bias, and proper polishing of the surface of the photosensitive drum 1 is enabled without making the rigidity of the fur brush 62 excessively large, so that the growth of the toner fusion can be suppressed while suppressing the shortened lifetime of the photosensitive drum 1.

As described above, in this embodiment, the image forming apparatus 100 includes the rotatable photosensitive member 1, the charging device 2 for charging the surface of the photosensitive member 1, the developing device 4 for supplying the toner to the surface of the photosensitive member 1, the transfer device 5 for transferring the toner (image) from the surfaces of the photosensitive drum 1 onto the transfer-receiving member 7 in the transfer roller Pd, and the cleaning device 6 for removing the toner from the surface of the photosensitive member 1, and the cleaning device 6 includes the cleaning blade 61 contacting the surface of the photosensitive member 1 in the blade cleaning position Pf downstream of the transfer position Pd and upstream of the charging position Pa with respect to the rotational direction of the photosensitive member 1, the rotatable roller-like brush 62 contacting the surface of the photosensitive member 1 in the brush cleaning position Pe downstream of the transfer position Pd and upstream of the blade cleaning position Pf with respect to the rotational direction of the photosensitive member 1, and the applying portion E5 for applying the bias to the brush 62. Further, in this embodiment, the image forming apparatus 100 satisfies: $48(\%) \leq E \leq 60(\%)$ and $400 \leq \{A \times B^2 \times C/D^2\} \leq 20408$ when in the environment of the temperature of 23° C. and the humidity of 50% RH, the brush fiber filament tensile strength is A (cn/dtex), the brush fiber filament thickness is B (denier), the bristle density per brush fiber filament is C (kF/inch$^2$), and the brush fiber length is D (mm), and in the environment of the temperature of 23° C. and the humidity of 50% RH, the elastic deformation rate in the case where the hardness test was conducted using the Vickers quadrangular pyramid diamond indenter is E (%). In this embodiment, when the image forming region of the surface of the photosensitive member 1 passes through the brush cleaning position Pe, the applying portion E1 applies the bias to the brush 62 so that the potential of the brush 62 becomes the opposite polarity to the normal charge polarity of the toner. Further, in this embodiment, the electric resistance of the brush 62 is 10 Log Ω or more and 12 Log Ω or less in the environment of the temperature of 23° C. and the humidity of 50% RH. Further, in this embodiment, the cleaning device 6 includes the electroconductive member 63 contacting the brush 62 and the removing member 64 for removing the toner from the electroconductive member 63, and the applying portion E5 applies the bias to the brush 62 via the electroconductive member 63. Further, in this embodiment, the brush 62 rotates with a speed difference between itself and the surface of the photosensitive member 1 in the same direction as the surface of the photosensitive member 1 in the contact portion with the photosensitive member 1.

Further, according to this embodiment, the occurrence of the toner fusion on the surface of the photosensitive drum 1 can be suppressed while achieving the lifetime extension of the photosensitive drum 1.

Embodiment 2

Next, another embodiment of the present invention will be described. Basic constitution and operation of an image forming apparatus 100 of this embodiment are the same as those of the image forming apparatus 100 of the embodiment 1. Accordingly, in the image forming apparatus 100 of this embodiment, as regards elements having the same or corresponding functions and constitutions as those in the image forming apparatus 100 of the embodiment 1, reference numerals or symbols which are the same as those in the embodiment 1 are added and detailed description thereof will be omitted.

Figure 9:
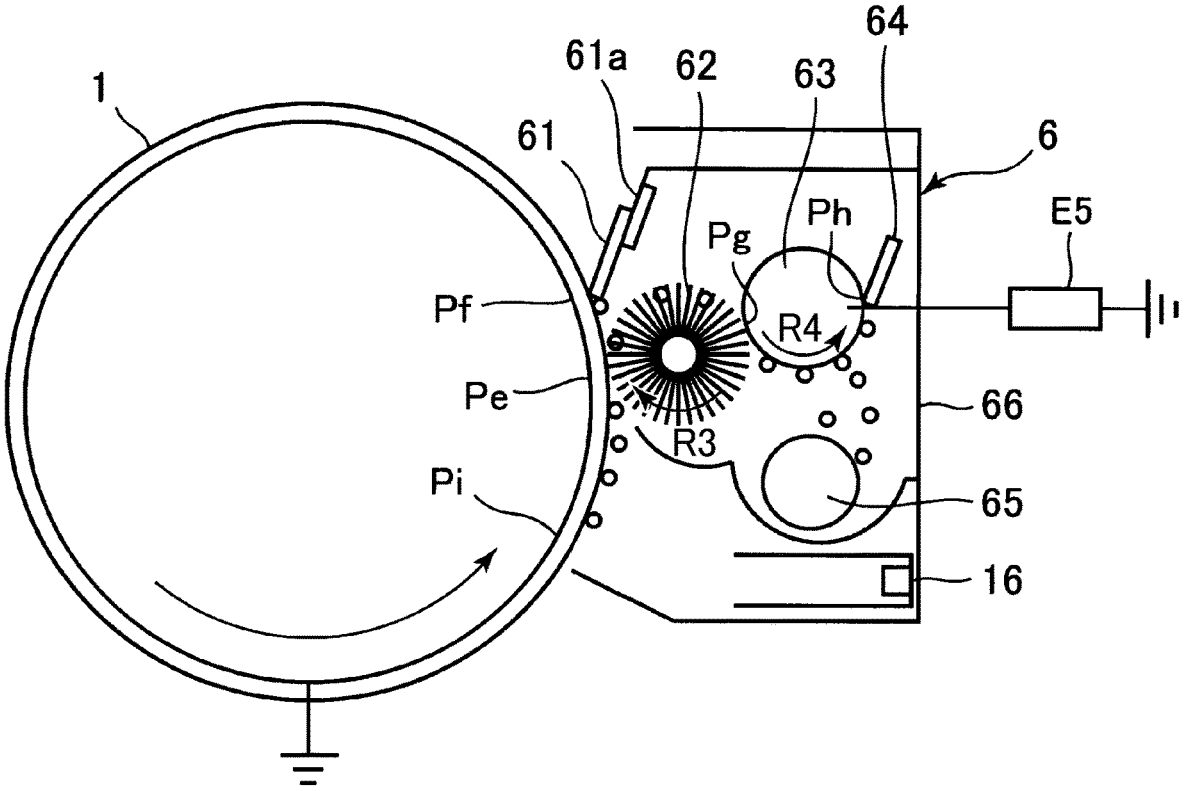
FIG. 9 is a schematic sectional view of a cleaning device and a periphery thereof in an embodiment 2.

FIG. 9 is a schematic sectional view of a cleaning provided 6 and a periphery thereof in this embodiment. In this embodiment, the image forming apparatus 100 includes a charge-removing device (pre-cleaning charge-removing device) 16 as a charge-removing means for removing the photosensitive drum 1 on a side downstream of the primary transfer portion T1 and upstream of the fur brush 62 with respect to the rotational direction of the photosensitive drum 1. In this embodiment, the charge-removing provided 16 removes the electric charges from the surface of the photosensitive drum 1 by irradiating the surface of the photosensitive drum 1 with light. A position of the photosensitive drum 1 where the electric charges are removed (the photosensitive drum surface is irradiated with light) by the charge-removing device 16 with respect to the rotational direction of the photosensitive drum 1 is a charge-removing position Pi. That is, with respect to the rotational direction of the photosensitive drum 1, the charge-removing position Pi is positioned downstream of the primary transfer position Pd and upstream of the brush cleaning position Pe. In this embodiment, the charge-removing device 16 employs an LED as a charge-removing light source, but may also use another means such as a semiconductor laser. Further, in this embodiment, the charge-removing device 16 uses constant-current control, and a current setting is 50 mA. This charge-removing device 16 removes the surface potential of the photosensitive drum 1 by emitting light toward the surface of the photosensitive drum 1 (precleaning exposure). Before the toner is electrostatically collected by the fur brush 62, by the charge-removing device 16, the surface potential (surface potential in the image forming region at least with respect to the rotational axis direction) of the photosensitive drum 1 is removed uniformly to about −100 to about 0 V. Incidentally, in this embodiment, similarly as the embodiment 1, the charge potential of the photosensitive drum 1 is about −500 V, and the exposure potential of the photosensitive drum 1 is about −200 V. The charge removal refers to removal of at least a part of the electric charges.

Here, in the case where the voltage applied to the fur brush 62 has the opposite polarity to the normal charge polarity of the toner and an absolute value of a potential difference between the fur brush 62 and the photosensitive drum 1 is preferably 250 V or more, the toner is electrostatically collected. On the other hand, when the absolute value of the potential difference between the fur brush 62 and the photosensitive drum 1 becomes a discharge start voltage (for example, 650 V) or more, the charge polarity of the toner on the photosensitive drum 1 is reversed (reverse polarization), so that the toner cannot be electrostatically collected from the photosensitive drum 1 to the fur brush 62. That is, the absolute value of the potential difference between the fur brush 62 and the photosensitive drum 1 may preferably be 50 V or more, more preferably be 250 V or more and less than the discharge start voltage. Incidentally, the discharge start voltage can be measured by the following measuring method. During formation of a solid white image, a current flowing from the fur brush 62 to the photosensitive drum 1 is measured while increasing the voltage applied to the fur brush 62 from 0 V. At this time, the current flows from at a certain threshold voltage. Herein, a voltage at which a current of 10 μA or more starts to flow was defined as the discharge start voltage.

In the case where the charge-removing device 16 is not provided, the potential difference between the fur brush 62 and the photosensitive drum 1 is different between a solid black image portion and a solid white image portion (non-image portion), so that the fur brush 62 cannot collect the toner and thus the toner fusion occurs in some cases. For example, this is because the absolute value of the potential difference between the photosensitive drum 1 and the fur brush 62 becomes the discharge start voltage or more at the solid white image portion and the charge polarity of the toner on the photosensitive drum 1 is reversed by the discharge. That is, as described in the embodiment 1, in order to suppress the brush rigidity index to a certain value or less for achieving the lifetime extension of the photosensitive drum 1, it is important that the occurrence of the toner fusion can be suppressed by stably maintaining the external additive dam layer through more proper collection of the toner before the toner reaches the external additive dam layer.

On the other hand, as in this embodiment, by providing the charge-removing device 16, the potential difference between the fur brush 62 and the photosensitive drum 1 is properly maintained, so that the toner can be properly collected by the fur brush 62. Further, in this embodiment, the occurrence of the toner fusion can be suppressed by more stably maintaining the external additive dam layer through more proper collection of the toner before the toner reaches the external additive dam layer, and therefore, in order to achieve the lifetime extension of the photosensitive drum 1, it becomes easy to suppress the brush rigidity index to a certain value or less.

Here, for each of a constitution in which the charge-removing device 16 is not provided and a constitution in which the charge-removing device 16 is provided, an experiment similar to the experimental examples in the embodiment 1 was conducted by changing the voltage applied to the brush (brush application voltage). That is, when the images were formed on 500,000 sheets in the high temperature/high humidity environment (30° C./80% RH), the surface states such as the surface abrasion and the surface roughness of the photosensitive drum 1 and the occurrence of the image defect due to the toner fusion were checked. Incidentally, in this embodiment, evaluation was performed by using the image forming portion 10K for black. Further, evaluation standards are the same as those for the experimental examples in the embodiment 1.

A result is shown in FIG. 10. From the result shown in FIG. 10, it is understood that in the case where the charge-removing device 16 is provided, the potential difference between the fur brush 62 and the photosensitive drum 1 is maintained uniformly in the rotational axis direction of the photosensitive drum 1 and the external additive dam layer is more stably maintained by more properly collecting the toner before the toner reaches the external additive dam layer, and thus the toner fusion can be suppressed. Further, in the case where the charge-removing device 16 is provided, a range (margin) of the brush application voltage in which the toner can be properly collected becomes broader than in the case where the charge-removing device 16 is not provided, by properly setting the potential difference between the fur brush 62 and the photosensitive drum 1.

As described above, in this embodiment, the image forming apparatus 100 includes the charge-removing device 16 for removing the electric charges from the surface of the photosensitive drum 1 in the charge-removing position Pi on a side downstream of the transfer position Pd and upstream of the brush cleaning position Pe with respect to the rotational direction of the photosensitive drum 1. In this embodiment, the charge-removing device 16 removes the electric charges of the surface of the photosensitive drum 1 by irradiating the surface of the photosensitive drum 1 with light. Further, in this embodiment, when the image forming region of the surface of the photosensitive drum 1 passes through the brush cleaning position Pe, the applying portion E5 applies the brush to the brush 62 so that the potential of the brush 62 becomes the opposite polarity to the normal charge polarity of the toner and the absolute value of the potential difference between the brush 62 and the surface of the photosensitive drum 1 from which the electric charges are removed in the charge-removing position Pi becomes less than the discharge start voltage.

Further, according to this embodiment, the occurrence of the toner fusion on the surface of the photosensitive drum 1 can be suppressed while achieving the lifetime extension of the photosensitive drum 1.

Other Embodiments

As described above, the present invention is described based on specific embodiments, but is not limited to the above-described embodiment.

For example, in the above-described embodiments, the rotatable roller-like brush is rotationally driven so as to move in the same direction as the photosensitive member in the contact portion with the photosensitive member, but the present invention is not limited thereto.

For example, a constitution in which the rotatable roller-like brush is rotationally driven so as to move in a direction opposite to the rotational direction of the photosensitive drum 1 in the contact portion with the photosensitive member and is rotated with a speed difference from the photosensitive member may also be employed. Similarly, in the above-described embodiments, the collecting member (electroconductive member) is rotationally driven so as to move in the same direction as the brush in the contact portion with the brush, but may also be rotationally driven so as to move in the opposite direction to the rotational direction of the brush.

Further, in the embodiment 2, the constitution in which the electric charges are removed by light as the charge-removing means was used, but the present invention is not limited thereto. For example, a constitution in which the electric charges are removed by AC discharge with a charger or by causing the electric charges to escape into an electroconductive member contacting the photosensitive member may also be employed.

Further, in the above-described embodiments, the image forming apparatus was the image forming apparatus employing the intermediary transfer type, but the present invention is also applicable to an image forming apparatus of a direct transfer type. As is well known by the person ordinarily skilled in the art, a tandem-type image forming apparatus employing the intermediary transfer type includes a recording material carrying member constituted by an endless belt or the like, in place of the intermediary transfer member in the above-described embodiments. Further, the toner images formed on the photosensitive members of the image forming portions are directly transferred onto the recording material carried and conveyed by the recording material carrying member, similarly as in the primary transfer in the image forming apparatus of the intermediary transfer type. Also, in such an image forming apparatus, by applying the present invention in conformity to the above-described embodiments, an effect similar to the effects of the above-described embodiments can be obtained.

Further, in the above-described embodiments, the number of the image forming portions was four, but the present invention is not limited thereto. The present invention is also applicable to an image forming apparatus including fine or more (for example, six) image forming portions. Further, in the above-described embodiments, the image forming apparatus has the constitution in which the toners of the four colors of Y, M, C and K, but the present invention is not limited to such embodiments. The image forming apparatus may also have a constitution in which transparent toner, metallic color toner, or the like may be used in addition to or in place of either one of Y, M, C and K.

Further, in the above-described embodiments, the image forming apparatus was the color image forming apparatus including the plurality of image forming portions, but the present invention is also applicable to a monochromatic (single color) image forming apparatus including only one image forming portion, for example.

According to the present invention, while achieving the lifetime extension of the photosensitive member, the occurrence of the toner fusion on the surface of the photosensitive member can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-132485 filed on Aug. 16, 2021, which is hereby incorporated by reference herein in its entirety.

What is claimed is:

1. An image forming apparatus comprising:

a rotatable photosensitive member;

an image forming portion configured to form a toner image on said photosensitive member;

a cleaning device configured to clean said photosensitive member, wherein said cleaning device comprises:

a blade contacting said photosensitive member at a first contact portion and configured to clean said photosensitive member;

a rotatable brush contacting said photosensitive member at a second contact portion upstream of the first contact portion with respect to a rotational direction of said photosensitive member and configured to collect toner remaining on said photosensitive member; and an applying portion configured to apply a bias to said brush; and a controller configured to control said applying portion, wherein said controller controls said applying portion so as to apply the bias to said brush so that a potential of said brush has a polarity opposite to a normal charge polarity of the toner when an image forming region of a surface of said photosensitive member passes through the second contact portion, and when a tensile strength of said brush is A (cn/dtex), a thickness of said brush is B (denier), a bristle density of said brush is C (kF/inch$^2$), a length of said brush is D (mm), and an elastic deformation rate of the surface of said photosensitive member is E (%), the following relationships are satisfied:

$$48(\%) \leq E \leq 60(\%), \text{ and}$$

$$400 \leq \{A \times B^2 \times C/D^2\} \leq 20408.$$

2. An image forming apparatus according to claim 1, further comprising:

a transfer device configured to transfer a toner image from said photosensitive member onto a transfer-receiving material in a transfer position; and a charge-removing device provided downstream of the transfer position and upstream of the second contact portion with respect to the rotational direction of said photosensitive member and configured to remove an electric charge from said photosensitive member.

3. An image forming apparatus according to claim 2, wherein said charge-removing device removes the electric charge from the surface of said photosensitive member by irradiating the surface of said photosensitive member with light.

4. An image forming apparatus according to claim 3, wherein when the image forming region of said photosensitive member passes through a brush cleaning position, said controller controls said charge-removing device so that a potential difference between said photosensitive member and said brush is 250 V or more and less than a discharge start voltage.

5. An image forming apparatus according to claim 1, wherein when the image forming portion of said photosensitive member passes through a brush cleaning position, said controller controls said applying portion so that a potential difference between said photosensitive member and said brush is less than a discharge start voltage.

6. An image forming apparatus according to claim 1, wherein an electric resistance of said brush is 10 Log Ω or more and 12 Log Ω or less in an environment of 23° C. in temperature and 50% in relative humidity.

7. An image forming apparatus according to claim 1, wherein said cleaning device further comprises an electroconductive member contacting said brush and a removing member configured to remove the toner from said electroconductive member, and wherein said applying portion applies the bias to said brush through said electroconductive member.

8. An image forming apparatus according to claim 1, wherein said brush is rotated in the same direction as a movement direction of the surface of said photosensitive member in the second contact portion, and is rotated with a speed difference relative to the surface of said photosensitive member.

9. An image forming apparatus according to claim 1, wherein said image forming portion comprises a developing device configured to develop an electrostatic image into the toner image on said photosensitive member, and wherein said developing device includes a developing sleeve for carrying a developer containing the toner and an external additive, and supplies the external additive to a cleaning portion during image formation.

10. An image forming apparatus according to claim 9, wherein said external additive is electrically charged to the polarity opposite to the normal charge polarity of the toner.

11. An image forming apparatus according to claim 10, wherein said external additive is inorganic fine powder of a perovskite-type crystal.

12. An image forming apparatus according to claim 10, wherein said external additive comprises silica or titanium oxide.

13. An image forming apparatus according to claim 10, wherein said external additive is strontium titanate.

14. An image forming apparatus according to claim 1, wherein the following relationship is satisfied:

$$400 \leq \{A \times B^2 \times C/D^2\} \leq 14000.$$

15. An image forming apparatus according to claim 1, wherein the following relationship is satisfied:

$$400 \leq \{A \times B^2 \times C/D^2\} \leq 10000.$$

* * * * *